US005600408A

United States Patent [19]

Horiuchi et al.

[11] Patent Number: 5,600,408

[45] Date of Patent: Feb. 4, 1997

[54] ELECTROPHOTOGRAPHIC COLOR IMAGE FORMING APPARATUS PROVIDED WITH A PLURALITY OF IMAGE EXPOSING DEVICES

[75] Inventors: Tatsumi Horiuchi; Satoshi Haneda, both of Hachioji, Japan

[73] Assignee: Konica Corporation, Tokyo, Japan

[21] Appl. No.: 522,680

[22] Filed: Sep. 1, 1995

[30] Foreign Application Priority Data

| | | | |
|---|---|---|---|
| Sep. 9, 1994 | [JP] | Japan | 6-216081 |
| Sep. 9, 1994 | [JP] | Japan | 6-216082 |
| Sep. 14, 1994 | [JP] | Japan | 6-220297 |

[51] Int. Cl.[6] ..... G03G 15/00; G03G 15/01

[52] U.S. Cl. ..... 399/39; 347/118; 399/51; 399/46; 399/72; 399/44

[58] Field of Search ..... 355/211, 317, 355/326 R, 327, 208; 347/116, 117, 118, 130

[56] References Cited

U.S. PATENT DOCUMENTS

| | | | |
|---|---|---|---|
| 4,752,804 | 6/1988 | Ohno | 355/327 |
| 5,121,145 | 6/1992 | Buch et al. | 347/118 |
| 5,274,394 | 12/1993 | Corona et al. | 347/130 X |
| 5,300,961 | 4/1994 | Corona et al. | 347/116 |

FOREIGN PATENT DOCUMENTS

| | | | |
|---|---|---|---|
| 5-307307 | 11/1993 | Japan | 355/327 |

*Primary Examiner*—Joan H. Pendegrass
*Attorney, Agent, or Firm*—Frishauf, Holtz, Goodman, Langer & Chick, P.C.

[57] ABSTRACT

A color image forming apparatus includes a controller to control an image carrier, plural chargers, plural image exposing devices, plural developing devices so that plural color toner images are formed one after another and superimposed on the image carrier, and a regulator to regulate a deviation in position among the plural color toner images.

29 Claims; 24 Drawing Sheets

ELECTROPHOTOGRAPHIC COLOR IMAGE FORMING APPARATUS PROVIDED WITH A PLURALITY OF IMAGE EXPOSING DEVICES

BACKGROUND OF THE INVENTION

The present invention relates to an electrophotographic color image forming apparatus in which a plurality of imagewise exposure means and a plurality of developing means are arranged along the circumferential surface of the image forming member, and toner images are superimposed on the surface so that a color image is formed while the image forming member makes one turn.

There have been known the following apparatuses as a method of forming a multi-color image:

an apparatus (A) in which photoreceptor drums, charging devices and developing devices each corresponding in number to colors necessary for forming the multi-color image are provided, and a mono-color toner image formed on each photoreceptor drum is superimposed one after another on an intermediate transfer member so as to form a color image, an apparatus (B) in which a single photoreceptor drum makes plural turns so that the charging, imagewise exposure and developing processes for each color are repeated so as to form a color image, and an apparatus (C) in which the charging, imagewise exposure and developing processes are conducted for each color sequentially while a single photoreceptor drum makes one turn so as to form a color image.

However, the apparatus (A) has a drawback that a size of the apparatus become too large because the plural photoreceptor drums and the intermediate transfer members are required. The dimensions of the apparatus (B) can be made relatively smaller because the required number of each of the charging means, imagewise exposure means and photoreceptor is only a single, however, the apparatus (B) has a limitation that the size of a formed image is limited not to be larger than the area of the circumferential surface of the photoreceptor drum.

For the aforegoing, apparatus (C) does not need plural photoreceptors and intermediate transfer objects, and thereby the apparatus can be made very small, and a size of an image is not restricted by the surface area of the photoreceptor, thereby large-sized images can be formed. Moreover, it is possible to carry out high speed image forming.

However, it is ncessary to provide plural sets of charging units, imagewise exposure means and developing units within a circumferential surface of the photoreceptor, and it is also necessary to superpose with high accuracy the toner images each having a different color formed by plural sets of imagewise exposure means and developing units. In particular, accuracy with which the plural toner images are superposed is affected by accuracy of imagewise exposure timing of plural imagewise exposure means on the photoreceptor. For example, position deviation of plural imagewise exposure means caused by temperature change, or position deviation of plural imagewise exposure means caused by inclination or non-linearity of imagewise exposure means such as, for example, LED array taking place in assembling, may cause a lag in the aforesaid imagewise exposure timing.

In addition, the imagewise exposure timing itself varies when an angular velocity of the photoreceptor changes. For example, when control is made to obtain constant peripheral speed, the angular velocity of the photoreceptor is changed by variation (rariation caused by temperature change or variation caused by replacement of a photoreceptor) of an outer diameter of the photoreceptor. As a result, color doubling is caused in superposing images each having a different color.

When the color doubling is caused, images each having a different color are superposed imperfectly, and the so-called color doubling is caused, resulting in inability of obtaining color images with high image quality.

The invention is to solve the problems mentioned above, and its object is to provide a color image forming apparatus wherein color doubling in superposed images made by plural imagewise exposure means on a photoreceptor can be adjusted automatically, and thereby each toner image can be superposed on the photoreceptor accurately for forming color images with high image quality.

In the case of a monochromatic image forming apparatus wherein an LED array composed of point light source arranged straight to be a straight line form, for example, is used as an imagewise exposure means mentioned above, when an amount of image deformation on a transfer material caused by tilt, a bend and doubling of a mounting position of the imagewise exposure means is small (approximately 0.1 mm), this deformation is not observed visually, causing no problem in practical use. Even in the case of the aforesaid apparatus (B) that is a color image forming apparatus of a type of collective transfer by multi-rotation, the deformation of each color image has been the same, causing no doubling in super position, because the same imagewise exposure means has been used for forming images each being different in color. However, in the case of apparatus (C) that is a color image forming apparatus when a plurality of imagewise exposure means are used and an image is formed within one turn through collective transfer, doubling and blotting are caused by tilt, skew and doubling of a mounting position of the imagewise exposure means, became imagewise exposure means each bring different for each color are used. Doubling and blotting tend to be observed visually (about 0.03 mm), causing a problem in practical use.

Namely, in the color image forming apparatus of apparatus (C), when arranged LED arrays are not uniform in linearity and directions, doubling is caused on superposed toner images, causing doubling and blotting which deteriorates a color image badly.

Problems stated above have been solved for improvement in the invention, and its second object is to provide color image forming apparatus (c) and a control method therefor wherein LED arrays are grouped in the primary scanning direction to be controlled in terms of exposure timing so that the LED arrays are corrected to be uniform in linearity and directions for exposure.

After solving the probems mentioned above to obtain improvement, the third object of the invention is to provide a color image forming apparatus wherein imagewise exposure timing for each of plural imagewise exposure means can be adjusted automatically depending on variation of a length of the circumferential surface of an image forming object and variation of exposure positions of LED arrays, and thereby toner images each having a different color can be superposed correctly to form a color image of high image quality.

SUMMARY OF THE INVENTION

The aforementioned first object of the invention can be attained by;

a color image forming apparatus having therein a plurality of charging means, imagewise exposure means and developing means all arranged in the vicinity of an image forming member so that charging, imagewise exposure and developing are repeated to form and superimpose on the image forming member the toner images which are transferred onto a transfer material at a time, wherein the aforementioned plural imagewise exposure means are arranged so that their intervals of imagewise exposure positions may be the same substantially, and imagewise exposure timing at each exposure position is adjusted depending on the fluctuation of peripheral speed of the image forming member (first example), a color image forming apparatus having therein a plurality of charging means, imagewise exposure means and developing means all arranged in the vicinity of an image forming member so that charging, imagewise exposure and developing are repeated to form and superimpose on the image forming member the toner images which are transferred onto a transfer material at a time, wherein imagewise exposure timing at each exposure position is adjusted in a geometrical ratio from its initial set point depending on intervals of imagewise exposure positions for the aforementioned plural imagewise exposure means (second example), and a color image forming apparatus having therein a plurality of charging means, imagewise exposure means and developing means all arranged in the vicinity of a drum-shaped image forming member so that charging, imagewise exposure and developing are repeated to form and superimpose on the image forming member the toner images which are transferred onto a transfer material at a time, wherein an angular velocity of the image forming member and imagewise exposure timing at the leading edge of an image as well as imagewise exposure timing in the primary scanning direction both for the aforementioned imagewise exposure means are regulated based on the common reference clock (third example).

The second object of the invention mentioned above is attained by both a color image forming apparatus forming therein an image forming member that is provided with a plurality of charging means, imagewise exposure means and developing means which repeat charging, imagewise exposure and developing so that toner images are superposed on the image forming member to be transferred collecting onto a transfer material, wherein the imagewise exposure means are arranged in a straight line form in the direction perpendicular to the moving direction of the image forming member, and they are divided into plural units in the direction of the image forming member so that each unit can expose independently, and there is provided an exposure timing control means which has a memory storing data of an amount of doubling between units generated when the reference image wise exposure means is superposed on another imagewise exposure means, and controls exposure timing of each unit of divided imagewise exposure means based on the aboveraid data, and a control method for a color image forming apparatus wherein, on a color image forming apparatus having therein an image forming member provided with a plurality of imagewise exposure means and forming a toner image by superposing toner images on the image forming member, and then transferring the image collectively, wherein the imagewise exposure means arranged in a straight line from are divided into plural units in the direction perpendicular to the moving direction of the image forming member so that each unit can make exposure independently, data of an amount of doubling between units generated when the reference imagewise exposure means is superposed on another imagewise exposure means are stored in a memory, and exposure timing for each unit of a divided imagewise exposure means can be controlled based on the abovesaid data stored. (Fourth example)

An LED array composed of LEDs arranged in a straight line form has its equivalent circuit shown in FIG. 21. When the LED array is used as an imagewise exposure means, it is normal that transfer of normal image data and imagewise exposure are made simultneously in terms of timing for entire area of LED array as shown in FIG. 19(*a*). For the purpose of saving the response time, however, there is also an example wherein the LED array is divided into some units as shown in FIG. 19(*b*) or 19(*c*) so that image data are divided to be transferred. However, even in that case, tilting or bending of the LED array apparatus on an image as tilt or a bend as it is, because the exposure timing is the same ever when exposure is conducted simultaneously for the entire LED array or is conducted for each unit individually. However, also in that case, even when exposure is made simultaneously in terms of timing for the entire LED array or individually in terms of timing for each unit, tilt or skew of the LED array appears as it is on an image as its tilt or bending.

In the invention, on the other hand, image data are divided and transferred for each unit as shown in FIG. 20, and exposure timing for each unit is controlled corresponding to the degree of tilt or skew and direction from the upstream side in the primary scanning direction, and thereby it is possible to obtain an image wherein tilt and skew of an LED array installed are corrected.

The third object of the invention mentioned above can be attained by the following color image forming apparatuses including a color forming apparatus (fifth example) having therein an image forming object on which toner images are superposed by repeating charging, exposure and development and having a transfer material onto which the toner images are transferred collectively, wherein the image forming object is provided with plural imagewise exposure means, and at least one of the image forming object and the imagewise exposure means can be replaced together with the corresponding registration control data, a color forming apparatus (sixth example) having therein an image forming object on which toner images are superposed by repeating charging, exposure and development and having a transfer material onto which the toner images are transferred collectively, wherein a test pattern mode for adjusting registration and a memory means capable of replacing or writing again the registration set values are provided, and the registration set values of the memory means are replaced or written again by the registration adjustment value obtained from the print by the test pattern, and a color forming apparatus (seventh example) having therein an image forming object and plural charging means, imagewise exposure means and developing means and on the image forming object toner images are superposed by repeating charging, exposure and development and having a transfer material onto which the toner images are transferred collectively, wherein plural test pattern modes by writing timing for registration adjustment is provided, the specific registration pattern is selected from prints by the plural test patterns for resetting as registration timing.

DETAILED DESCRIPTION OF THE PREFERRED EMBODIMENTS

Figure 1:
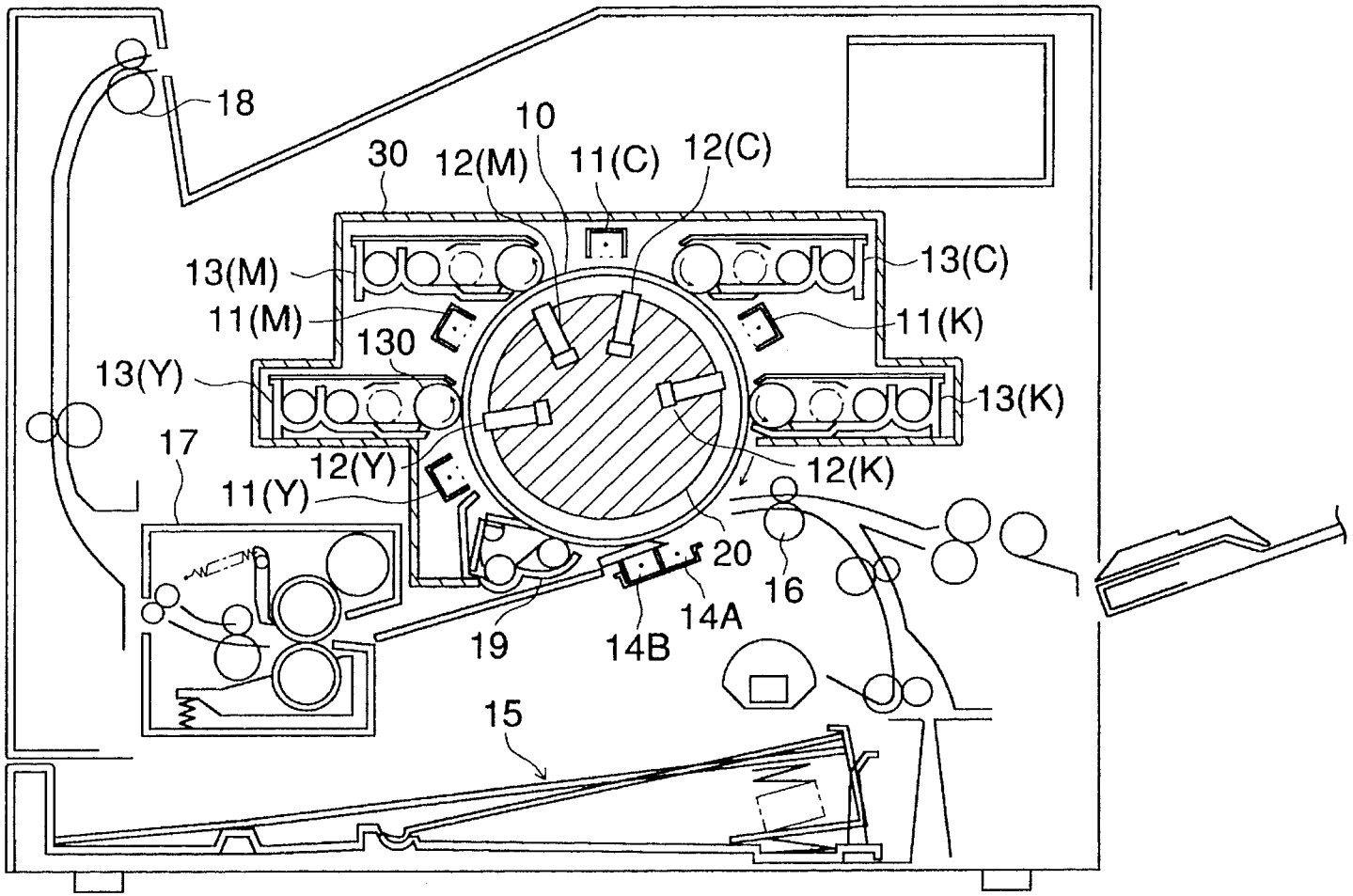
FIG. 1 is a structural cross section of a color image forming apparatus of the invention.
Figure 2:
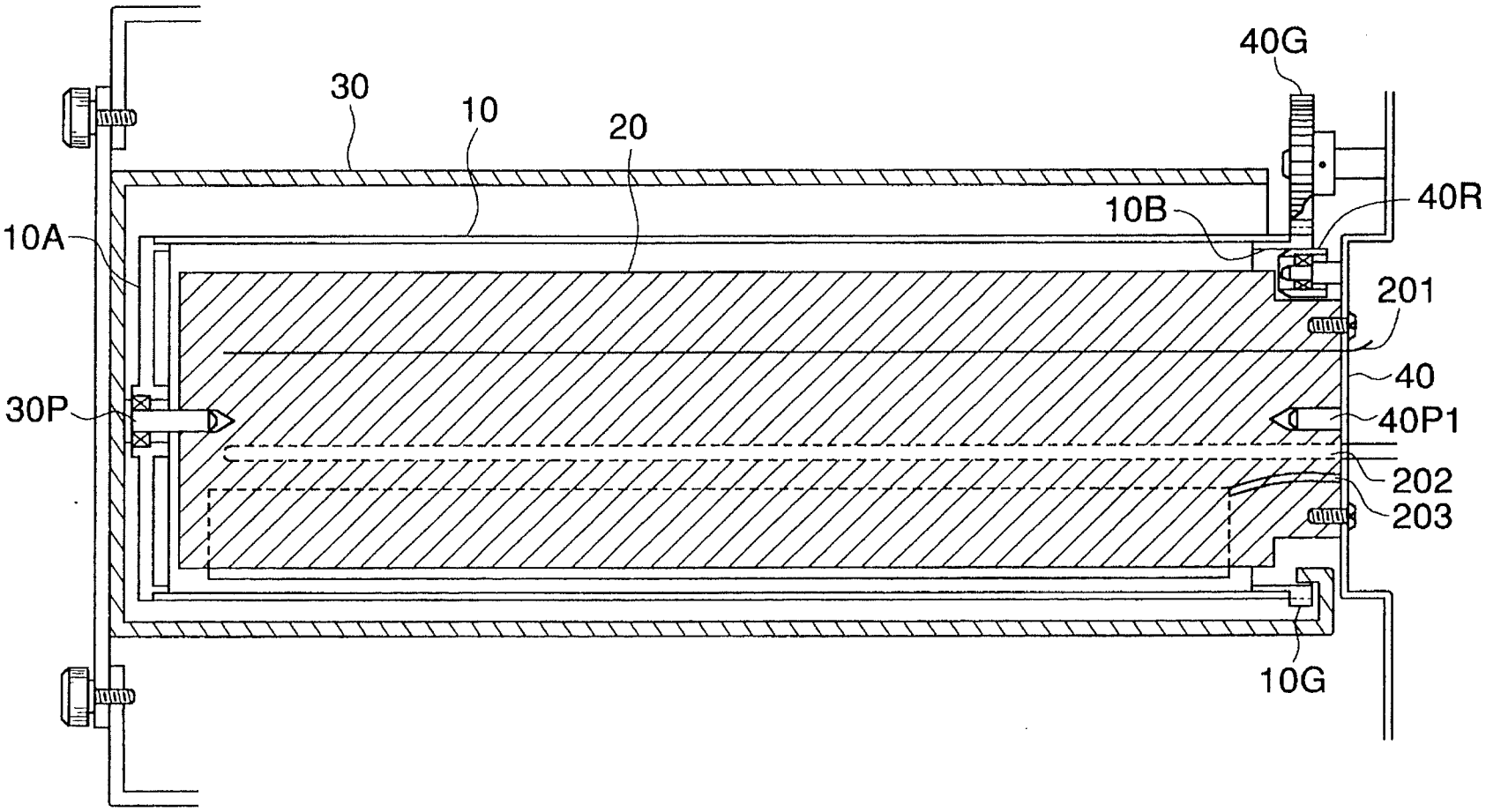
FIG. 2 is a structural cross section of an image forming section.

Before explaining each example of the invention, the constitution of a color image forming apparatus that is common to all of the inventions will be explained as follows, referring to FIGS. 1, 2 and 3.

The numeral 10 is a drum-shaped image-forming member, that is, a photoreceptor drum, and it is made in such a manner that an outer circumferential surface of a cylindrical base member made of an optical glass or a transparent member such as transparent acrylic resins is coated with a transparent conductive layer 10*b* and an organic photoconductor layer (OPC).

A flange 10A at one end of the photoreceptor drum 10 is supported by a guide pin 30P with a bearing in a cartridge 30 which will be explained later. An inner circumferential surface of a flange 10B at the other end of the photoreceptor drum 10 is fit with a plurality of guide roller 40R provided on a base plate 40 of the apparatus body. A gear 10 on an outer circumferential surface of a flange 10B is engaged with a driving gear 40G so that the photoreceptor drum 10 is rotated clockwise by the driving force through the driving gear 40G on a condition that the above-mentioned transparent conductive layer is grounded.

The numeral 11 represents a scorotron charging unit which charges electrically through both a grid kept at a predetermined potential level against the organic photoconductor layer of the photoreceptor drum 10 and corona discharging by a corona wire, whereby the photoreceptor drum 10 is given an uniform potential.

Numeral 12 represents an optical exposure system composed of LEDs aligned in the axial direction of the photoreceptor drum 10 and SELFOC lenses. Image signals for each color read by a separate image reading device are taken out successively from a memory and are inputted as electric signals into each of the optical exposure systems 12.

Each of the optical exposure systems 12 is attached on a cylindrical pillar-like supporting member 20 which is guided by a guide pin 40P1 and fixed on the base plate 40 of the apparatus body, whereby the optical exposure systems are accommodated inside of the photoreceptor drum 10.

The numerals 13Y to 13K are developing devices containing respectively a corresponding one of developing agents of yellow (Y), magenta (M), cyan (C) and K (black), and each developing device is equipped with a developing sleeve 130 which locates to keep a predetermined gap distance to a circumferential surface of the photoreceptor drum 10 and rotates in the same direction as that of the photoreceptor drum 10.

Each developing device conducts a reversal development on a non-contact condition under an application of a developing bias voltage for an electrostatic latent image which has been formed on the photoreceptor drum 10 through a charging process by the charging device 11 and an imagewise exposure process by the optical exposure system 12.

Next, a color image forming process in the apparatus of the present invention will be explained.

An image on a document read by an image sensor in an image reading device which is separate from the present apparatus, or an image compiled by a computer is stored in a memory temporarily as image signals of each color of Y, M, C and K.

At the start of an image recording, a photoreceptor driving motor starts rotating so as to rotate clockwise the photoreceptor drum 10 and, simultaneously, the scorotron charging unit 11 (Y) starts providing an electric potential to the photoreceptor drum 10 through its charging action.

After the photoreceptor drum 10 has been provided with the electric potential, an imagewise exposure is started by electric signals corresponding to the first color signals, that is, yellow (Y) image signals in the optical exposure system 12 (Y), and an electrostatic latent image corresponding to a yellow (Y) image of the document image is formed on a light-sensitive layer on the surface of the drum with the rotary scanning of the drum.

The latent image is subjected to the reversal development conducted by a developing unit 13 (Y) under the non-contact condition of developing agent on a developing sleeve, and a yellow (Y) toner image is formed on the photoreceptor drum 10 as the photoreceptor drum 10 rotates.

Then, photoreceptor drum 10 is further provided with an electric potential on the yellow (Y) toner image formed thereon through a charging operation of the charging unit 11 (M), then an imagewise exposure is conducted by electric signals corresponding to the second color signals, that is, magenta (M) image signals, in the optical exposure system 12 (M), and a magenta (M) toner image is superimposed on the aforementioned yellow (Y) toner image through the non-contact type reversal development by the developing unit 13 (M).

In the same process as in the foregoing, a cyan (C) toner image corresponding to the third color signals is formed and superimposed by the charging unit 11 (C), optical exposure system 12 (C) and developing unit 13 (C), and, then, a black (K) toner image corresponding to the fourth color signals is formed and superimposed in succession by the charging unit 11 (K), the optical exposure system 12 (K) and the developing unit 13 (K), whereby a color toner image is formed on the circumferential surface of the photoreceptor drum 10 within its one rotation.

Exposure to an organic photoconductor layer of photoreceptor drum 10 is conducted by the optical exposure systems mentioned above through the transparent base member from the inside of the drum. Therefore, the imagewise exposures corresponding to the second, third and fourth color signals can be conducted respectively without receiving any influence of the toner images formed previously, thus it is possible to form an electrostatic latent image equivalent in quality to that corresponding to the first color signals. Incidentally, with regard to the stabilization of a temperature and the prevention of a temperature rise in the photoreceptor drum 10 against a heat generated by the optical exposure systems 12, it is possible to attain them to a certain level, by taking the following steps. A material having an excellent thermal conductivity is used for the supporting member 20. When the temperature is low, heater 201 is used, while it is high, heat is released to the outside through heat pipe 202. In the case of developing operation conducted by each developing unit, developing bias in which DC is added or AC is further added is applied on each developing sleeve 10, then the jumping development with one-component or two-component developing agent contained in the developing unit is conducted, and the non-contact type reversal development is carried out for the photoreceptor drum 10 having a grounded transparent conductive layer.

A color toner image thus formed on the peripheral surface of the photoreceptor drum 10 is transferred in a transfer device 14A onto a transfer sheet which is fed out from sheet feed cassette 15 and is conveyed synchronously with the toner image on the photoreceptor drum 10 by the drive of the timing roller 16.

Transfer sheet onto which the toner image has been transferred is electrically discharged by the discharger **14*b*, so Chat the transfer sheet P is separated from the peripheral surface of the drum. In a fixing unit 17, the toner image is fused and fixed onto the transfer sheet. After that, the transfer sheet is discharged to a paper discharge tray on a upper portion of the apparatus through a paper discharge rollers 18**.

On the other hand, after the transfer sheet has been separated from the photoreceptor drum 10, the residual toner on the surface of the photoreceptor drum 10 is removed and the surface of the photoreceptor drum 10 is cleaned in a cleaning device 19. In this way, the toner image formation is continued for a document image, or alternatively the toner image formation is once stopped and the apparatus advances to a next toner image formation for a new document image.

The photoreceptor drum 10, the charger 11, developing unit 13 and cleaning unit 19 are integrally accommodated in the cartridge 30. Under the above integrating condition, the cartridge 30 can be attached to and detached from the apparatus body while the support member 20 having the optical exposure system 12 is left in the apparatus body.

Figure 3:
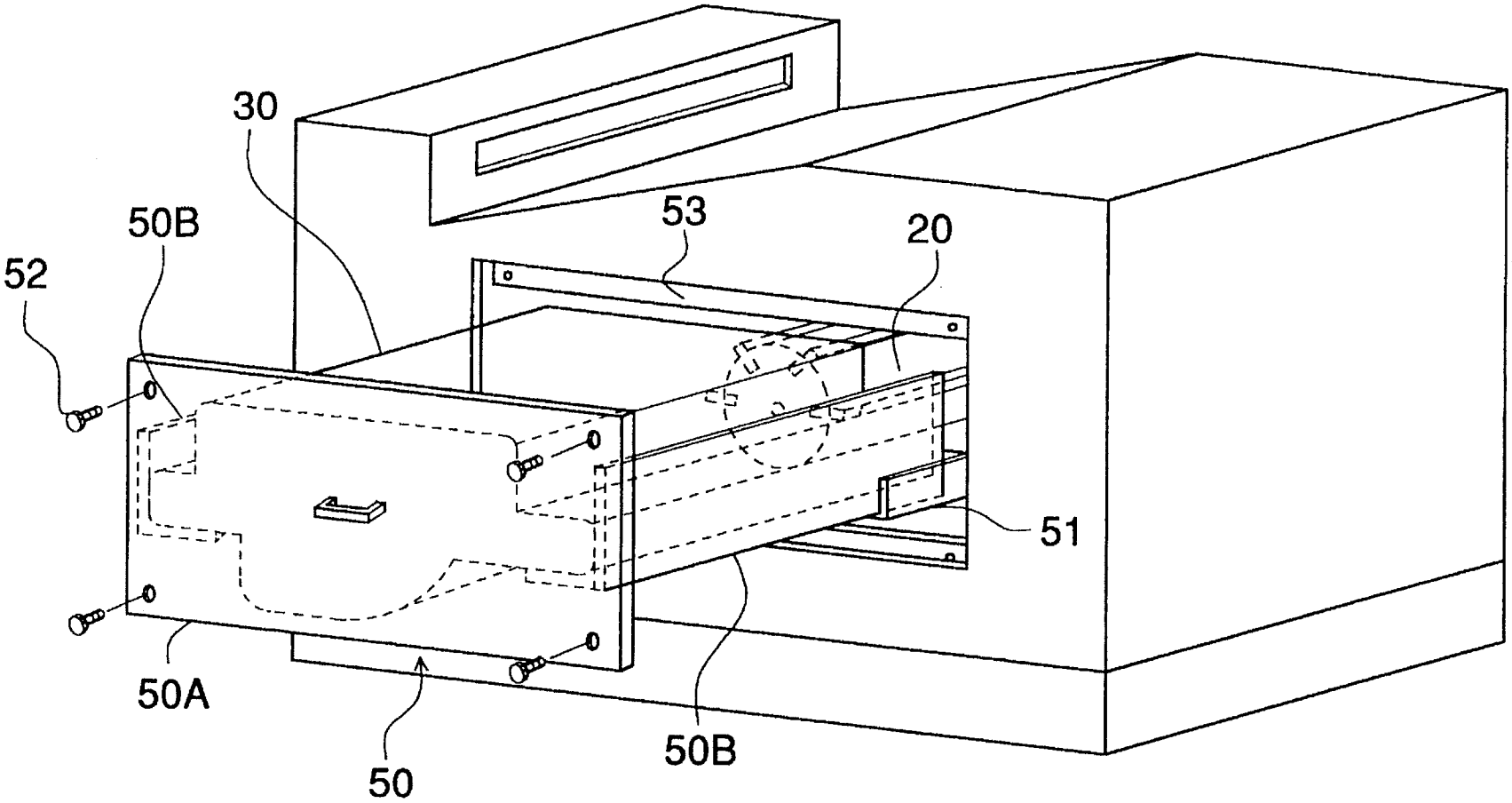
FIG. 3 is a perspective view showing how the image forming section is mounted or dismounted.

Namely, the cartridge 30 as shown in FIG. 3 is accommodated in a movable frame 50 detachably attached to the side of the apparatus body.

The above structure in which the support member 20 is left in the apparatus body in the operation for attachment and detachment has an advantage that the heater 201, heat pipe 202, lead 203 for acting LED, and optical exposure system 12 can be affixed to the support member 20 even if the photoreceptor drum is rotated, attached or detached. Further, it is possible to use the above structure for determining the axis of the photoreceptor drum 10 as mentioned below.

When mounting, the movable frame 50 is composed of a side plate 50A and a support mount 50B integrated with the side plate 50A. Under the condition that the cartridge 30 is provided on the movable frame 50 and further the position is regulated, the movable frame 50 is horizontally slid along the guide rails 51.

When the movable frame 50 is inserted into the apparatus, a guide pin 30P for supporting the photoreceptor drum 10 is engaged with the support member 20 for attaching the optical exposure system 12, and then the internal circumferential surface of the flange 10B is fit with the guide roller 40R on the base plate 40. Thereafter, the side plate 50A is closely contacted with the collision portion 53 of the apparatus body, and the screw 52 is used as a fixing means for fixing the movable frame 50. With this construction, the axis of the photoreceptor drum 10 and the center of the photoreceptor drum 10 in its axial direction can be positioned precisely in relation to the image forming section.

When dismounting, the movable frame 50 is pulled out from the apparatus body, the slide movement of the movable frame 50 is stopped at a position where the photoreceptor drum 10 is released from the support member 20 on which each optical exposure system 12 is mounted, so that the movable frame 50 is supported by the guide rails 51.

When the movable frame 50 is pulled out, the flange 10B of the photoreceptor drum 10 is disengaged from the guide roller 40R mounted on the base plate 40 and supported by several folding portions 30A formed integrally with the cartridge 30, so that the axial position of the photoreceptor drum 10 can be maintained in the same position as that of insertion of the movable frame 50. Accordingly, when the movable frame 50 is inserted again, it is easy for the flange 10B to engage with the outer periphery of the guide rollers 40R, so that the axial position of the photoreceptor drum 10 can be maintained at the correct position.

In the above-mentioned examples, photoreceptor drum 10 can be replaced as a cartridge. However, it is also possible that an optics exposure system is replaced as a cartridge for the apparatus main body. Namely, the optics exposure system 12 can also be drawn out of the apparatus in the same manner as in the aforementioned cartridge 30, by taking the support plate 40A out of base board 40 of the apparatus main body after pulling out the carriage 50 from the inside of the apparatus.

(EXAMPLE 1)

An example of the first invention in the present invention will be explained as follows, referring to FIGS. 4 and 5.

The aforesaid apparatus in which positional intervals of optical exposure systems 12 (Y), 12 (M), 12 (C) and 12 (K) are set to be identical each other substantially is structured so that accurate superposition of images can be attained with predetermined imagewise exposure timing when the peripheral speed of photoreceptor drum 10 is controlled depending on the length of a circumferential length of the photoreceptor drum 10 and variation of distances of the optical exposure systems 12.

A length of a circumferential surface of photoreceptor drum 10 and a fluctuation amount ($\Delta L_1$) of the distance ($L_1$) between optical exposure systems 12 on the surface of photoreceptor drum 10 are detected indirectly by the temperature difference from the reference temperature sensed by a temperature sensor. Further, with regard to the photoreceptor drum 10, a fluctuation amount ($\Delta L_0$) of the reference length ($L_0$) of a circumferential surface caused by drum replacement is shown on a label indicating dimensions of an outside diameter, for example.

Figure 4:
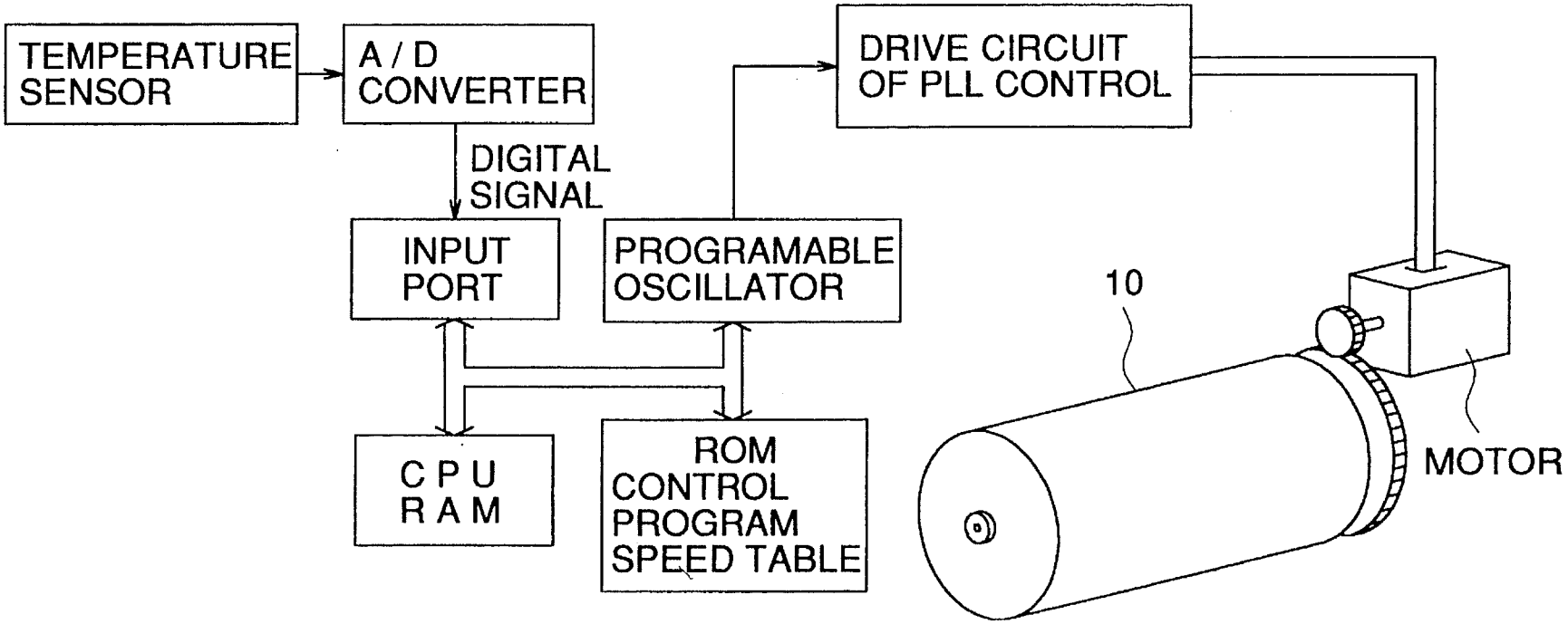
FIG. 4 is an illustration showing how the registration is controlled for the fluctuation in temperature of an image forming member.

FIG. 4 shows a system wherein a fluctuation amount of a distance on the circumferential surface of photoreceptor drum 10 between optical exposure systems 12 is detected through the detection of temperature, thereby, based on information of the detection of the fluctuation amount, peripheral speed of the photoreceptor drum 10 is controlled so that a problem of doubling caused not by exposure positions of imagewise exposure means arranged at equal intervals against the photoreceptor drum 10 which remain unchanged but by the change of ambient temperature can be resolved.

Temperature data of both photoreceptor drum 10 and supporting member 20 for optical exposure systems 12 (temperature difference from the reference temperature) obtained by a temperature sensor are converted into digital signals and are inputted in CPU, ROM and a programmable oscillator.

The aforesaid digital signals related to temperature make the programmable oscillator to generate clock signals with a predetermined frequency based on the table of peripheral speeds of a photoreceptor corresponding to temperature data representing a control program stored in ROM by CPU.

The aforementioned clock signals are sent to a driving circuit of a PLL control system to control the number of rotations of a motor and thereby to adjust peripheral speed of photoreceptor drum 10, thus, slip of imagewise exposure caused by temperature fluctuation can be solved. Namely, when assuming that the reference speed of revolution of the photoreceptor drum 10 is u and temperature difference from the reference temperature is t, peripheral speed of rotation obtained from the table is shown by $u\times(1+ct)$.

In this case, c represents a value that approximates to the coefficient of linear expansion obtained experimentally.

Figure 5:
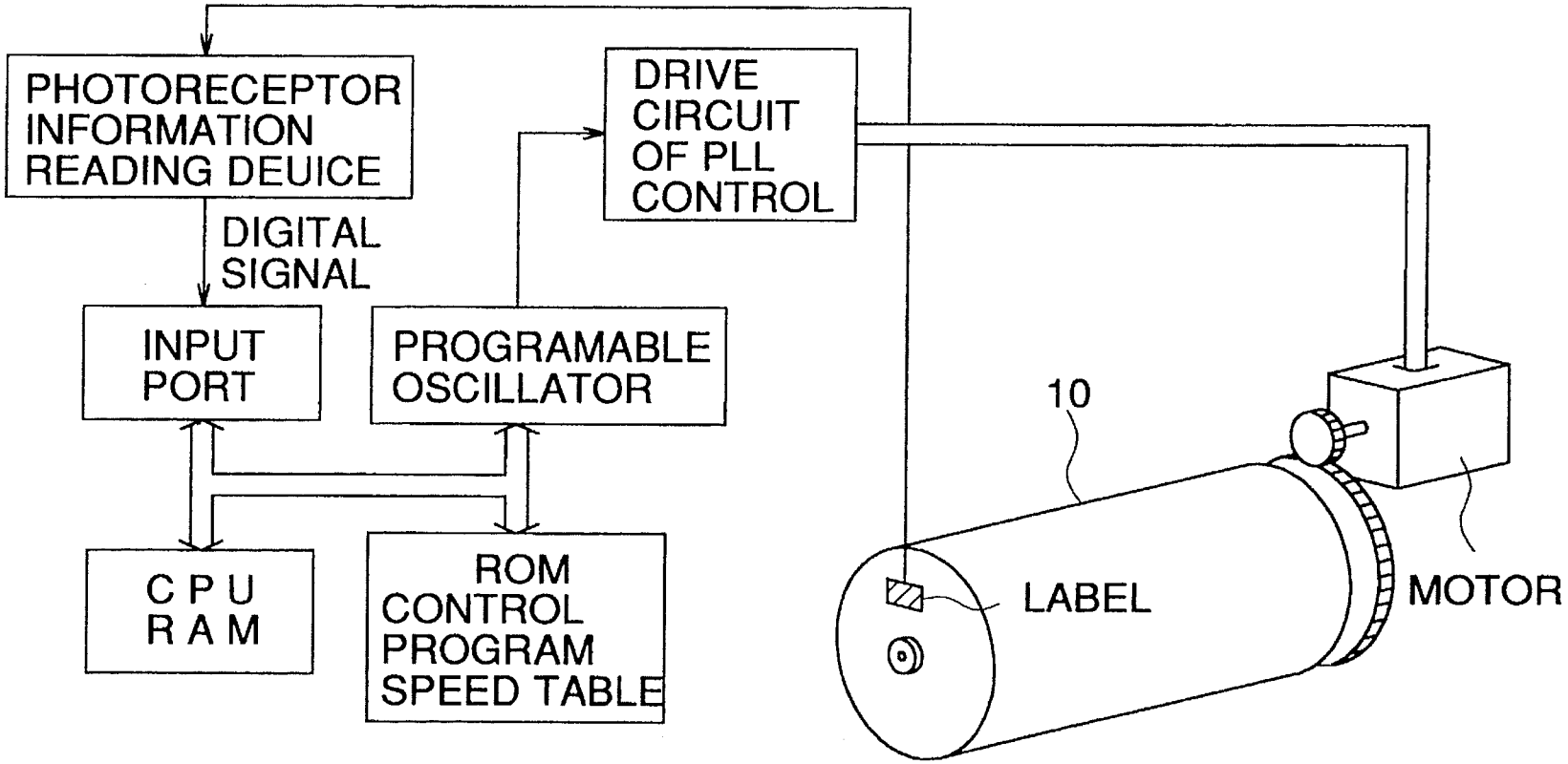
FIG. 5 is an illustration showing how the registration is controlled for the conversion of an image forming member.

FIG. 5, on the other hand, shows a system wherein peripheral speed of rotation of photoreceptor drum 10 is controlled based on information of an outside diameter or a length of circumferential surface of photoreceptor drum 10 changed after replacement with a new one.

On the outside of the photoreceptor drum 10 mentioned above, information of dimensions of its outside diameter or the length of its circumferential surface are indicated through a bar code on a label or the like, and these information are read by a photoreceptor information reading device on the occasion of replacement of the photoreceptor drum, and are inputted directly in CPU, ROM and a programmable oscillator as digital signals.

The aforesaid read signals make the programmable oscillator to generate clock signals with a predetermined frequency based on the table of photoreceptor speeds corresponding to an outside diameter of the photoreceptor or a length of circumferential surface of the photoreceptor representing a control program stored in ROM by CPU.

Then, the clock signals mentioned above are sent to a driving circuit of a PLL control system to control the number of rotations of a motor and thereby to adjust peripheral speed of photoreceptor drum 10, thus, slip of imagewise exposure caused by replacement of a photoreceptor drum can be solved.

Namely, when assuming that the reference speed of revolution of the photoreceptor drum 10 is u and a length of the reference circumferential surface of the photoreceptor drum 10 is $L_0$, peripheral speed of rotation obtained from the table is shown by $u\times(1+\Delta L_0/L_0)$ for the replacement with the photoreceptor drum whose length of circumferential surface is $(L_0+\Delta L_0)$, thereby, the peripheral speed of rotation can be controlled and doubling can be prevented.

The aforesaid control of peripheral speed of a photoreceptor drum can also be carried out under judgment of image forming output without controlling the speed based on detection of ambient temperature or dimension information of a photoreceptor drum replaced. For example, it is possible to employ a method wherein registration patterns are formed with various toners on an image forming member, an amount of registration (an amount of doubling between patterns of various colors) is detected, or registration patterns on a transfer sheet are subjected visual check, and a value of peripheral speed of the photoreceptor drum or a specific value corresponding to that value of peripheral speed is selected from the table of collation between forms of registration patterns and peripheral speeds of a photoreceptor drum prepared separately, and is inputted, thus it is possible to change and set to the optimum peripheral speed that causes no doubling.

(EXAMPLE 2)

Figure 11:
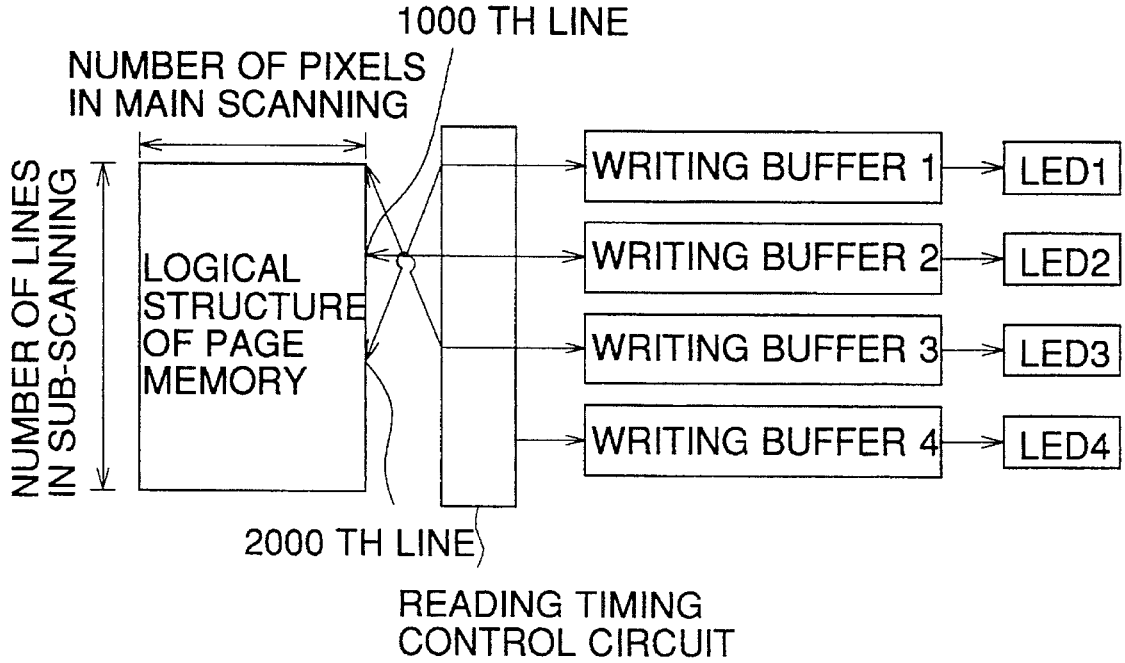
FIGS. 11(*a*) and 11(*b*) are illustrations showing reading timing for the third color (C).
Figure 11:
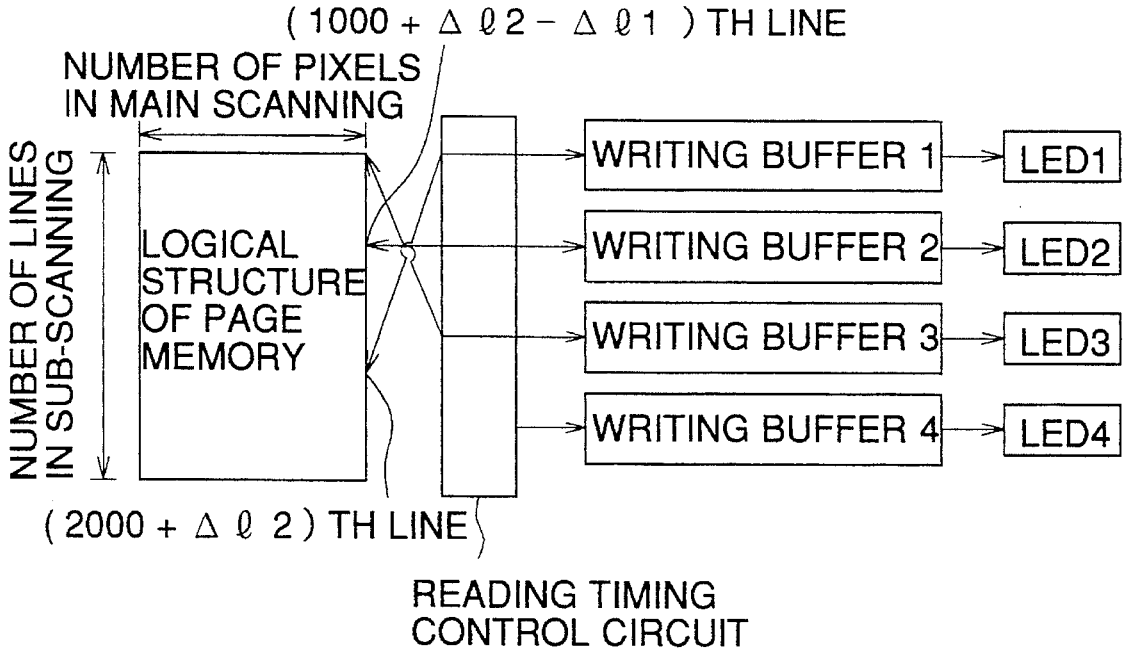

The second invention in the present invention will be explained as follows, referring to FIG. 11.

The aforesaid apparatus is structured so that the imagewise exposure timing can be controlled and thereby the aforesaid toner image of each color can be superimposed accurately when emission timing of an LED array that is a light source of each optical exposure system 12 is adjusted and controlled, in a geometrical ratio, from the initially set value in accordance with positional intervals of optical exposure systems 12 (Y), 12 (M), 12 (C) and 12 (K).

The length of a circumferential surface of photoreceptor drum in use and fluctuation amount ($\Delta L_1$, $\Delta L_2$ and $\Delta L_3$) for distances ($L_1$, $L_2$ and $L_3$) between LED arrays of optical exposure systems 12 on the photoreceptor drum 10 caused by temperature change are detected indirectly by a temperature difference from reference temperature sensed by a temperature sensor, while, an amount of change ($\Delta L_0$) for reference length ($L_0$) of a circumferential surface of the photoreceptor drum 10 caused by replacement with a fresh photoreceptor drum is indicated on a label showing dimensions of an outside diameter of the photoreceptor drum.

Figure 6:
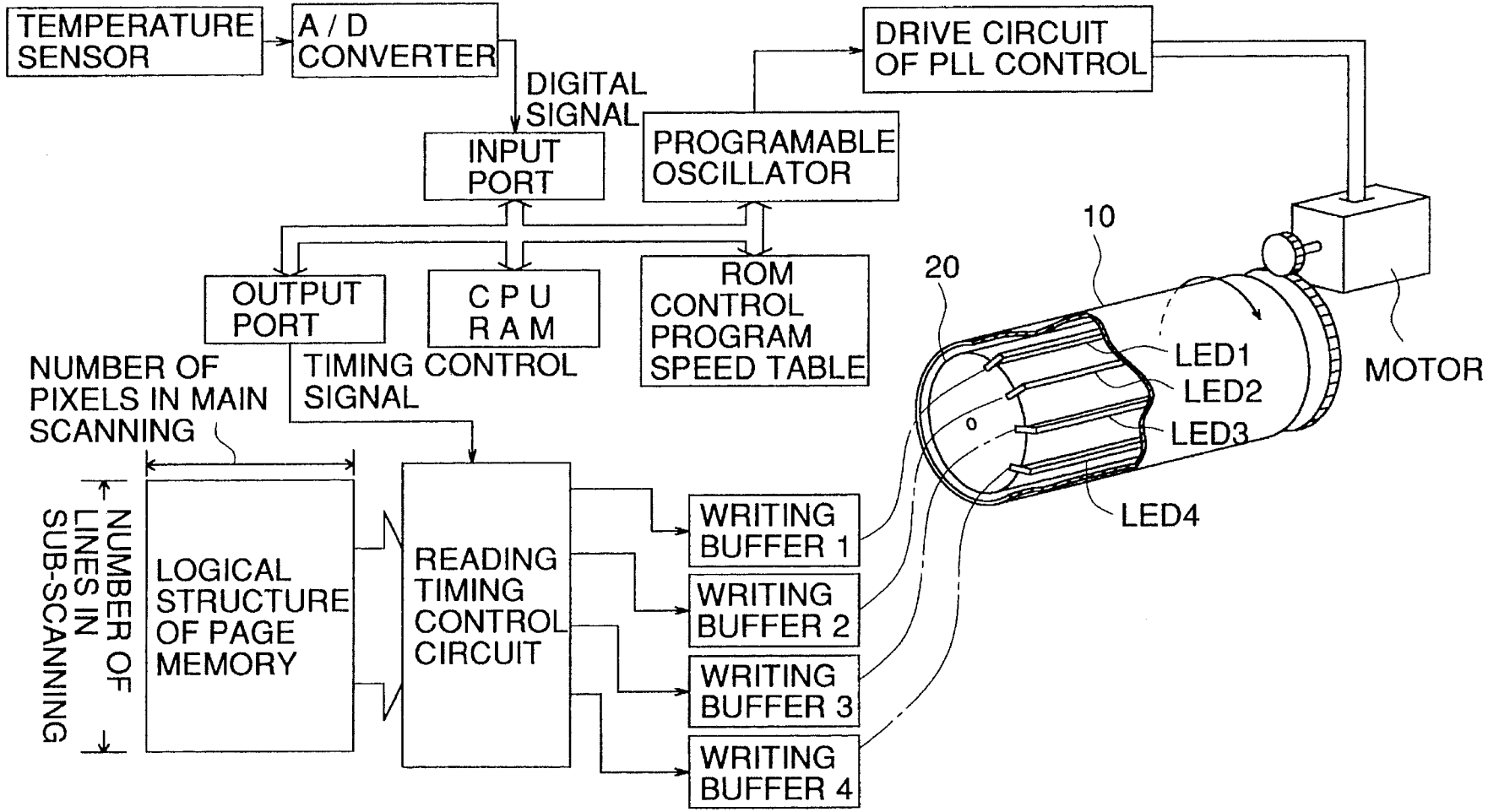
FIG. 6 is an illustration showing how the registration of an optical exposure system is controlled for the fluctuation in temperature.

FIG. 6 shows a system wherein a fluctuation amount for a distance between optical exposure systems 12 on a circumferential surface of photoreceptor drum 10 in use is detected through temperature detection, and based on information of that detection, emission timing of each LED array of each optical exposure system 12 is controlled.

Temperature data of supporting member 20 that supports photoreceptor drum 10 and each optical exposure system 12 detected by a temperature sensor are converted into digital signals and then are inputted in CPU, ROM and a oscillator capable of programming.

Based on the table of photoreceptor peripheral speeds corresponding temperatures in a control program stored in ROM by CPU, the digital signals related to temperature mentioned above make the oscillator capable of programming to generate a clock signal with a predetermined frequency.

The clock signal mentioned above is sent to a driving circuit of a PLL control system to control the number of rotations of a motor, and thereby adjusts peripheral speed of photoreceptor drum 10 to the designated speed.

In the present invention, the digital signal mentioned above is inputted also in a reading timing control circuit as an imagewise exposure timing control signal, and is utilized for reading timing control for pixels stored in a page memory. In the invention, imagewise exposure timing for each exposure position is adjusted, in a geometrical ratio, from the value of initial setting, depending on intervals of imagewise exposure positions of imagewise exposure means, which will be explained concretely as follows.

Figure 8:
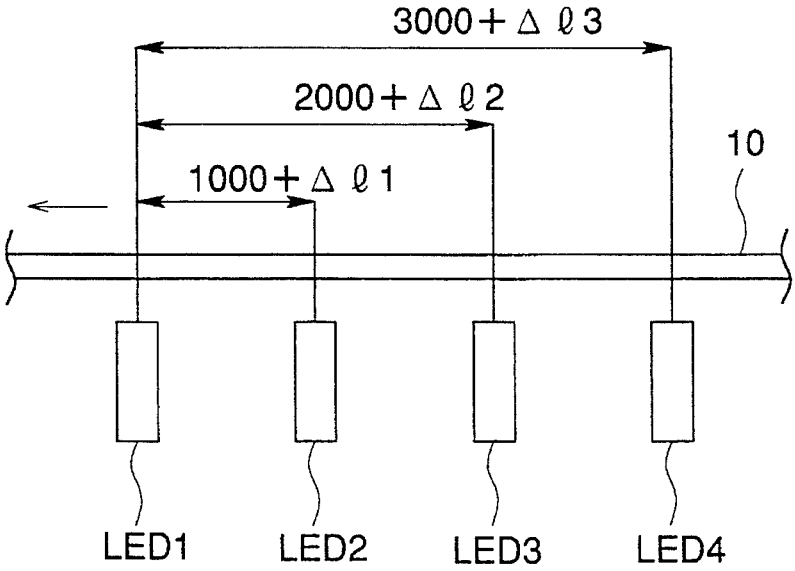
FIG. 8 is an illustration showing the variation of intervals of optical exposure systems.

When assuming that the aforesaid page memory is composed, for example, of 5000 pixels as the number of pixels in the primary scanning direction and of 6000 lines as the number of lines in the sub-scanning direction, and LED array of each optical exposure system 12 is arranged at intervals of 1000 pixels at detection temperature of 20° C. for a photoreceptor, temperature rise causes expansion of the aforesaid supporting member 20, extension of intervals between LED arrays and an increase of the number of pixels in each interval, thus, intervals each being a distance between LED1 and each of LED2, LED3 and LED4 are extended to correspond to the number of pixels ($1000+\Delta L_1$, $2000+\Delta L_2$ and $3000+\Delta L_3$) shown in FIG. 8, when LED arrays of optical exposure systems 12 (Y), 12(M), 12(C) and 12(K) are assumed to be LED1, LED2, LED3 and LED4.

Figure 9:
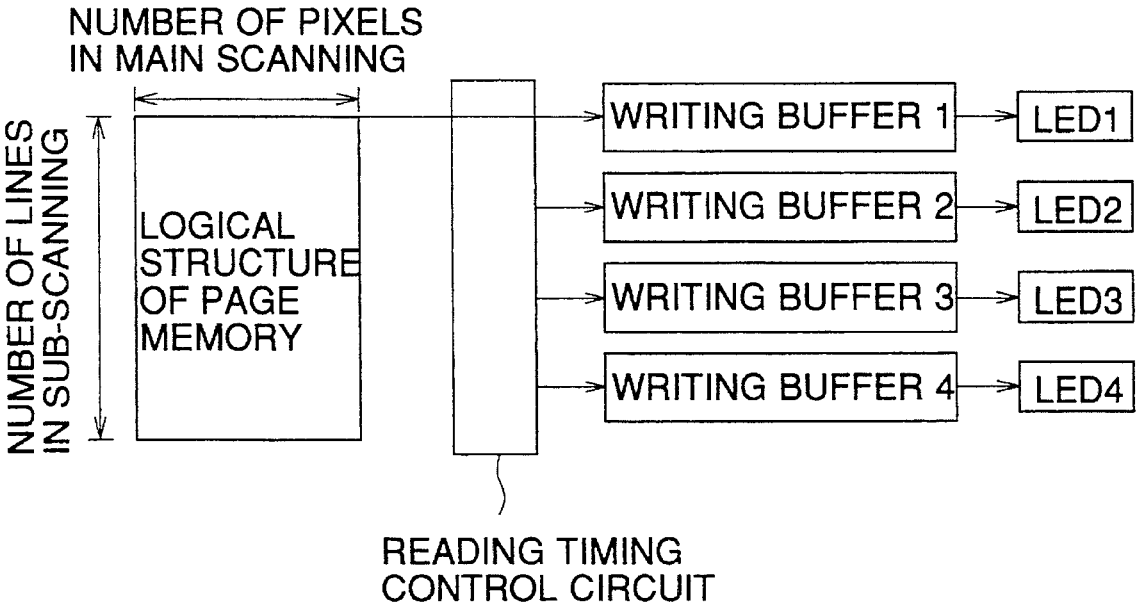
FIG. 9 is an illustration showing reading timing for the first color (Y).

Reading of the first color (Y) of the image data constituting the aforesaid page memory is not controlled in terms of reading timing independently of high and low of detection temperature as shown in FIG. 9. The data of reading are stored temporarily in writing buffer 1, and then writing on the light-sensitive surface is started in accordance with a value of initial setting upon emission of LED 1.

Figure 10:
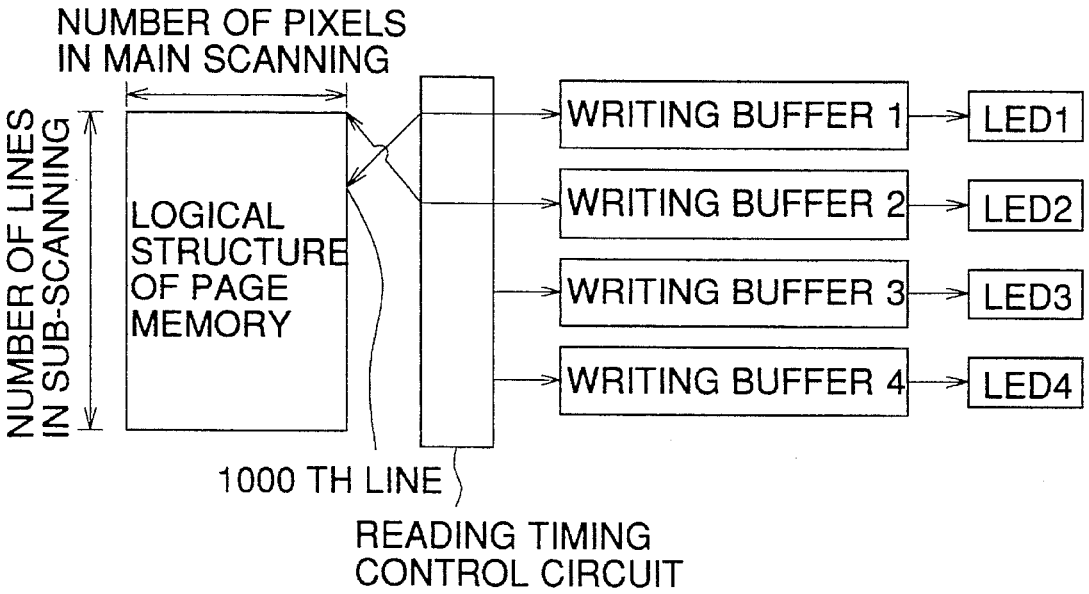
FIGS. 10(*a*) and 10(*b*) are illustrations showing reading timing for the second color (M).
Figure 10:
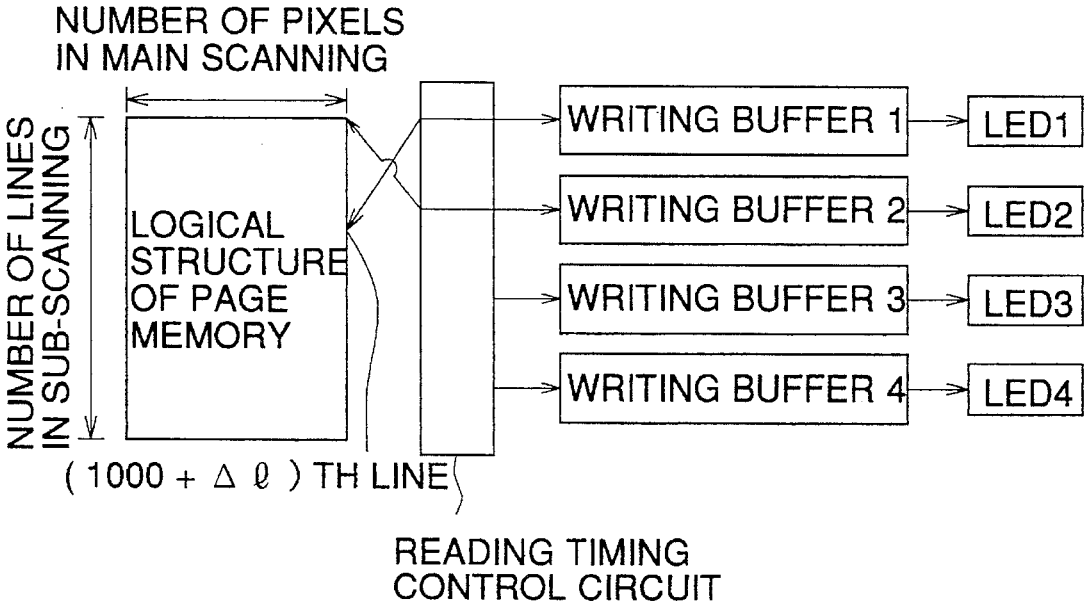

With regard to the reading for the second color (M), when the detection temperature is 20° C. which is a reference temperature, reading timing for the start of reading the second color (M) is controlled so that the reading may be synchronized with the moment when the aforesaid reading for the first color (Y) reaches 1000 lines as shown in FIG. 10(*a*). When the detection temperature is 20° C. or higher, on the other hand, reading timing is controlled for the start of reading the second color (M) so that the reading may be synchronized with the moment when writing of the first color (Y) on the light-sensitive surface reaches ($1000+\Delta L_1$) lines as shown in FIG. 10(*b*). The data of reading the second color (M) are stored temporarily in writing buffer 2, and then writing on the light-sensitive surface is started upon emission of LED2.

With regard to the reading for the third color (C), when the detection temperature is 20°C., reading the third color (C) is started while the reading timing is controlled so that the start of reading is synchronized with the moment when the aforesaid writing of the first color (Y) reaches 2000 lines, namely, when the writing of the second color (M) reaches 1000 lines. When the detection temperature is 20° C., on the other hand, the reading is started while the reading timing is controlled so that the start of reading is synchronized with the moment when the aforesaid writing of the first color (Y) reaches ($2000+\Delta L_2$) lines, namely, when the writing of the second color (M) reaches ($1000+\Delta L_2-\Delta L_1$) lines, With regard to writing of image data of the fourth color (K), again, reading is started with different reading timing in accordance with a control program selected, in a same process, by the temperature difference between detection temperature and the reference temperature, and writing is started through writing buffer 4 when LED 4 is emitted.

Thus, depending on intervals of exposure positions of imagewise exposure means, imagewise exposure timing for each of them is automatically adjusted, in a geometrical ratio, from the initially set value in accordance with temperature change of supporting member 20 that supports photoreceptor drum 10 and optical exposure system 12, thereby a toner image of each color can be superimposed accurately, resulting in realization of formation of color images excellent in color balance.

When the detection temperature is not more than 20° C., signs of the aforesaid $\Delta L_1$, $\Delta L_2$ and $\Delta L_3$ are inverted, and writing timing is controlled in the same way as the foregoing.

Figure 7:
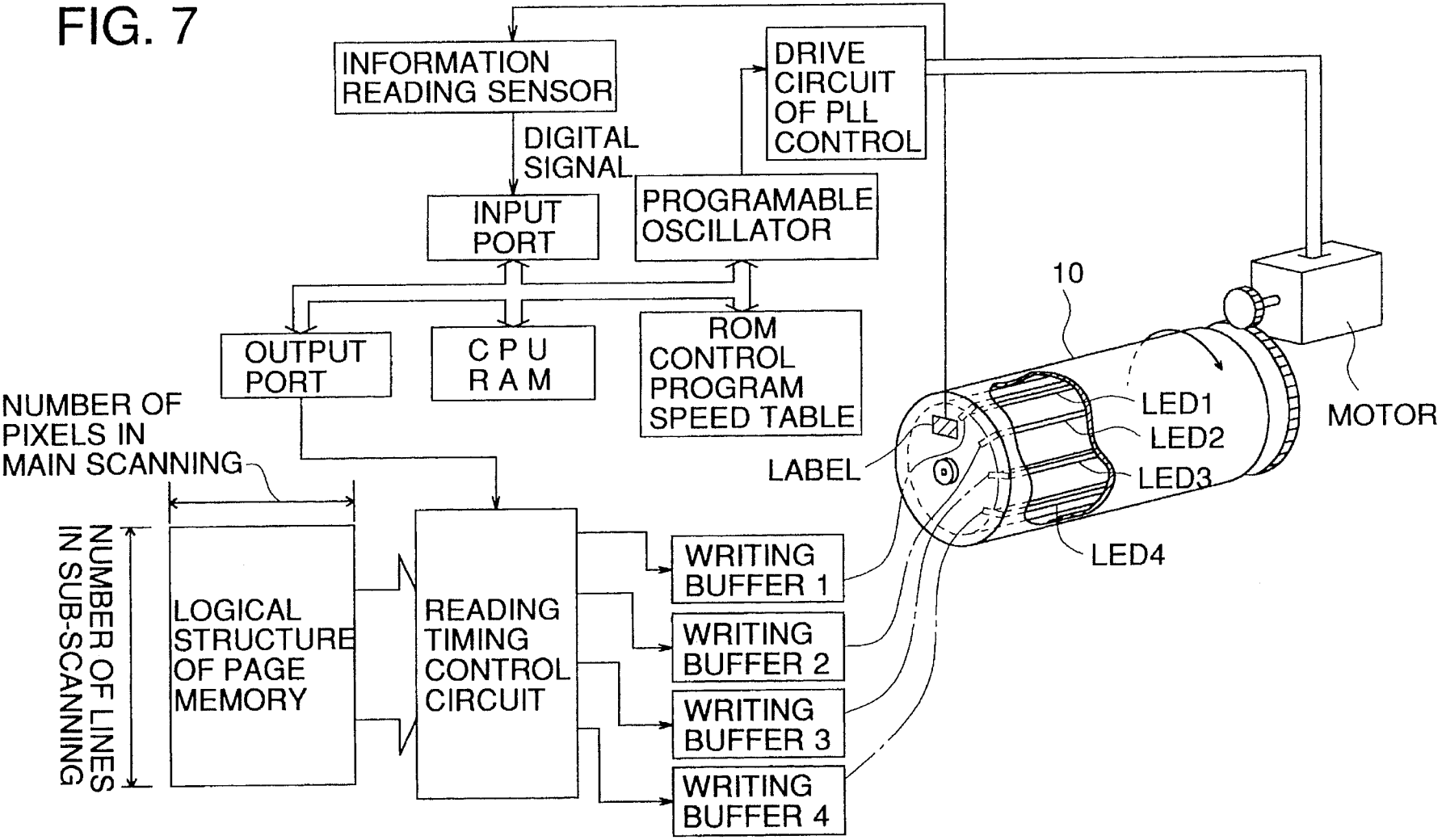
FIG. 7 is an illustration showing how the registration of an optical exposure system is controlled for replacement.

On the other hand, FIG. 7 shows a system wherein the speed of revolution of photoreceptor drum 10 and imagewise exposure timing are controlled based on the length of circumferential surface of photoreceptor drum 10 changed by replacement with a new photoreceptor drum. With regard to the length of circumferential surface of the photoreceptor drum 10, information of dimensions of an outside diameter indicated on a label is inputted automatically by a reading device provided on a color image forming apparatus or manually, and imagewise exposure timing is controlled by the control program selected by the aforesaid inputted information, in a geometrical ratio, from the initially set value in the same process as in FIG. 6 depending on intervals of imagewise exposure positions.

Incidentally, though the control of imagewise exposure timing mentioned above is conducted based on detection of ambient temperature and information of dimensions of a photoreceptor drum replaced, it can also be conducted through judgment of image forming output. For example, the imagewise exposure timing can also be changed or established in a way wherein registration patterns each being of a different color toner are formed on an image forming member, a registration amount (an amount of a shear in printing between the patterns) is detected, or registration patterns on a transfer sheet are subjected to visual detection, and a value of timing or a specific value to be set to the value of timing is selected from a collation table representing the relation between forms of registration patterns and imagewise exposure timing prepared separately, then the value is inputted.

(EXAMPLE 3)

An example of the third invention in the present invention will be explained as follows, referring to FIGS. 12 and 13.

In a color image forming apparatus of the invention, the aforesaid photoreceptor drum 10 is driven to rotate keeping its angular velocity constant by a motor controlled in its speed of revolution by pulse signals generated by a clock, and timing for imagewise exposure by an imagewise exposure means for the leading edge of an image and that in the primary scanning direction are also controlled by pulse signals generated by a clock so that constant intervals may be maintained.

Figure 12:
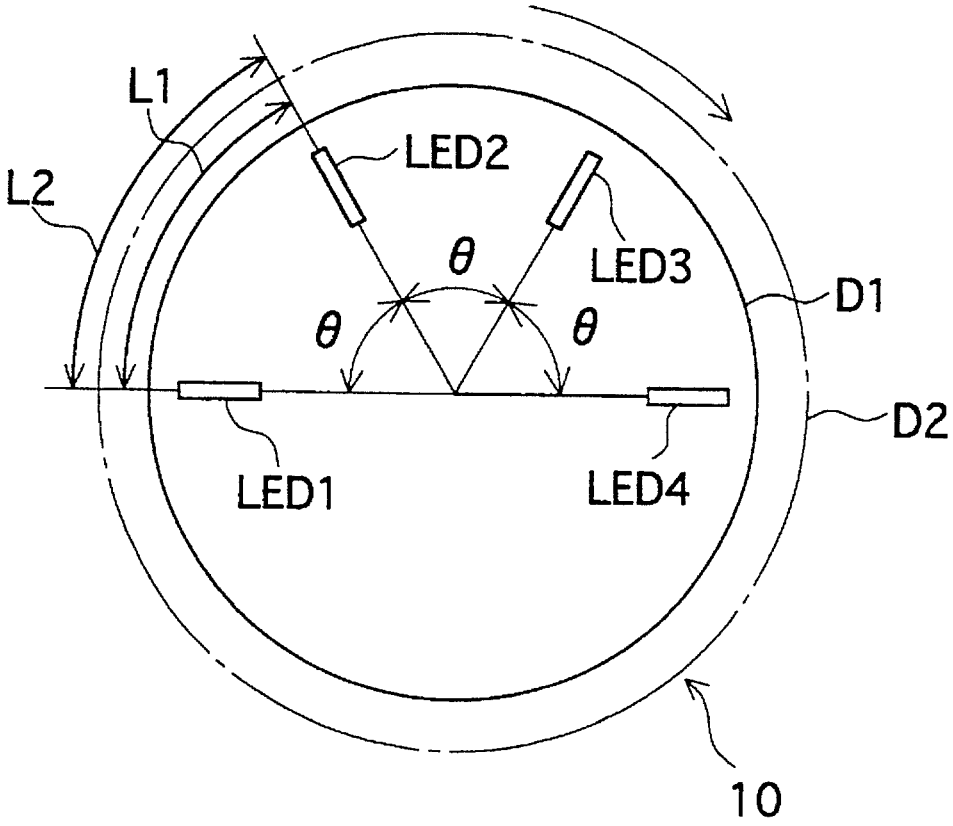
FIG. 12 is an illustration showing the change in length of a circumferential surface of a photoreceptor caused by the change of temperature.

On the photoreceptor drum 10, therefore, even when its outside diameter is changed by fluctuation of temperature in use or by its replacement with a new one from D1 to D2 as shown in FIG. 12, $\Delta L_1$ which is a difference between distance $L_1$ between LED arrays each being a light source of optical exposure system 12 and $L_1+\Delta L_1$ only requires slight change of printing density, and imagewise exposure timing, namely the registration of a toner image of each color is not changed and requires no adjustment.

Figure 13:
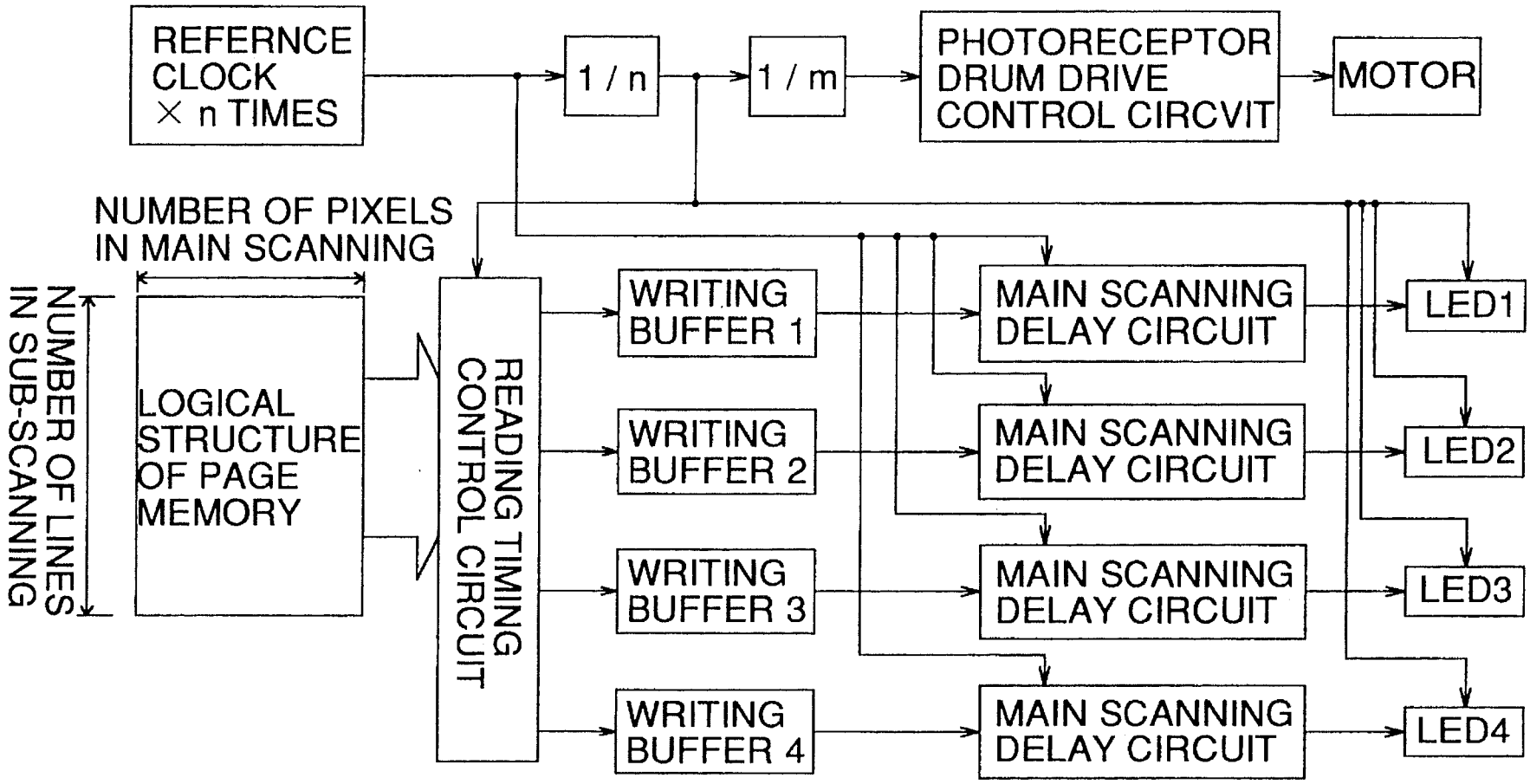
FIG. 13 is an illustration showing how the speed of revolution of an image forming member and imagewise exposure timing of an optical exposure system are controlled by a reference clock.

FIG. 13 is a block diagram showing how the driving and control are conducted based on a reference clock and the driving and control for a pulse motor which rotates photoreceptor drum 10 are conducted by pulse signals generated by the reference clock. Even for imagewise exposure of $LED_{1-LED4}$, the start of imagewise exposure and the driving as well as control of timing for imagewise exposure in the primary scanning direction are conducted based on pulse signals generated by the same reference clock. Namely, image information of a document read is image-processed and then is stored temporarily in a page memory, then image information for each color is sent to each of writing buffers 1–4 by a reading timing control circuit. Image information sent to each writing buffer is sent to a primary scanning delay circuit for each image information corresponding to one line in primary scanning direction or for each image information corresponding to plural lines in primary scanning direction, and thereby the start of exposure of LED representing an exposure means of an optical exposure system and the driving as well as control of exposure timing in primary scanning direction are conducted in accordance with a digitized writing program that is established in advance and incorporated in ROM, under driving and control by the reference clock.

A color image forming apparatus in which writing positions (deviations) for images on a transfer sheet can be adjusted is structured so that imagewise exposure timing both for the leading edge of an image and for the primary scanning direction are changed based on the reference clock when the aforesaid deviation is adjusted, and owing to this, a shear in forming toner images is not caused even when ambient temperature fluctuates.

Though optical exposure systems are provided inside a photoreceptor drum in each color image forming apparatus explained in the present example as stated above, the invention is not limited thereto and optical exposure systems may also be provided on the periphery (outside) of the photoreceptor drum. Further, an image forming member in the invention may also be a photoreceptor belt wherein a photoreceptor is formed on a belt-shaped base member, without being a photoreceptor drum. Even in this case, a color image forming apparatus wherein plural charging means, plural imagewise exposure means and plural developing means are provided in the vicinity of an image forming member and toner images are superimposed on the image forming member, which is either of a type of imagewise exposure from the inside of the photoreceptor belt or of a type of imagewise exposure from the outside of the photoreceptor belt can be included in the invention.

Owing to the invention, timing of imagewise exposure can be controlled and adjusted automatically depending on fluctuations and changes of peripheral speed of an image forming member and a distance between imagewise exposure means, resulting in an offer of a color image forming apparatus capable of forming a quality image with high accuracy of superposition of toner images.

(EXAMPLE 4)

Figure 14:
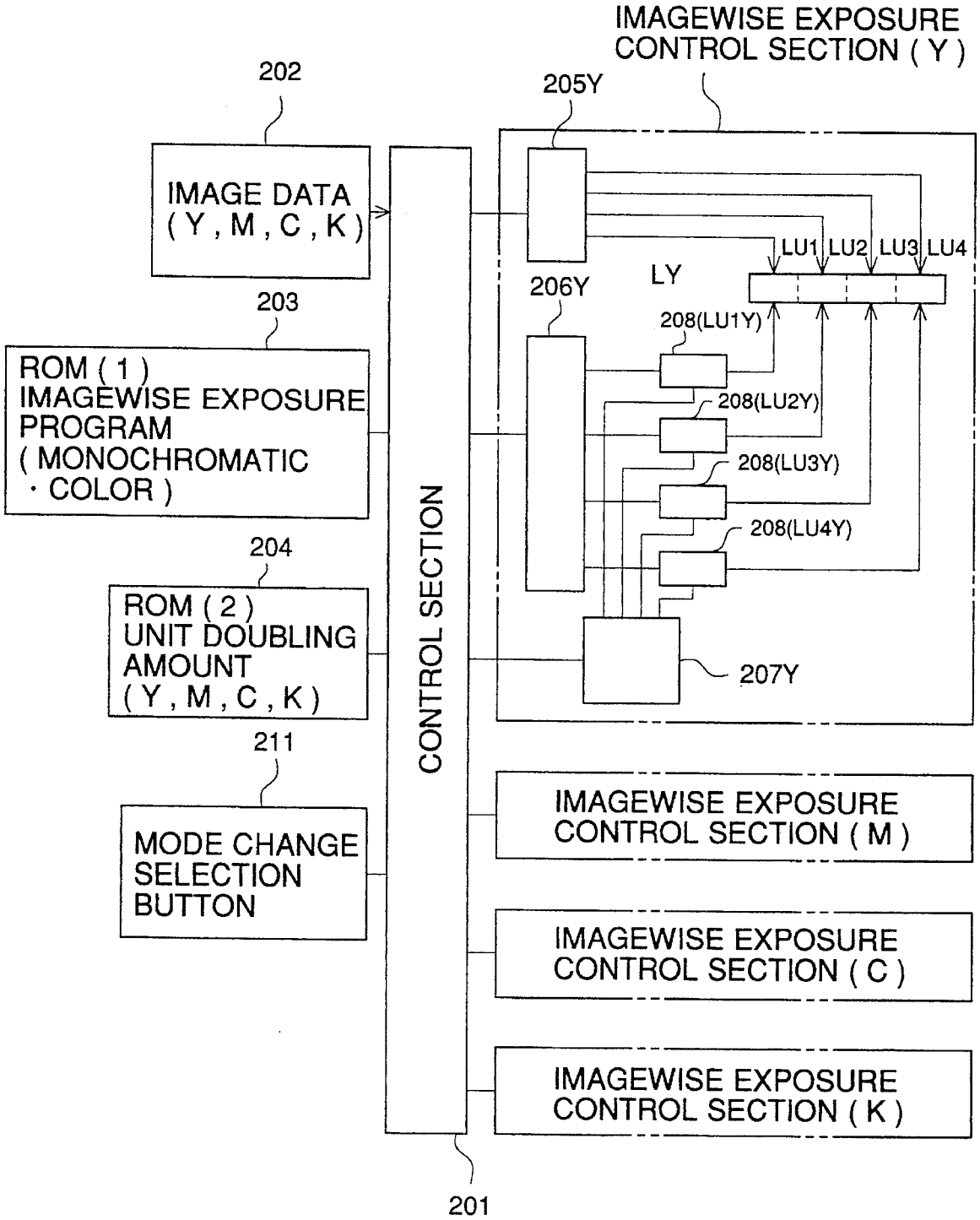
FIG. 14 is a block diagram showing the circuit structure of an imagewise exposure control section of the invention.

FIG. 14 is a block diagram showing the circuit structure of an imagewise exposure control section of the invention. Image information inputted from the outside and those obtained through reading by an image reading device are inputted in control section 201 as image data of each color of Y, M, C and K after being subjected to image-processing. In ROM(1)203, monochromatic and multi-color imagewise exposure programs are recorded, and when a monochromatic mode is selected by mode selection button 211, the selected monochromatic imagewise exposure program is outputted to control section 201, while, when a color mode is selected , an imagewise exposure program for each color of Y, M, C, and K is outputted to the control section 201.

In the invention, an amount of doubling of each unit generated when an LED array (LS) that is a reference for optical exposure system 12 explained later is superposed on another LED array (L), for example, LED array (LY) of optical exposure system 12(Y) for yellow(Y) is written in ROM(2) 204 to be stored. As an LED array (LS) to be a reference, an LED array (LK) for black(K) is preferably used.

Figure 15:
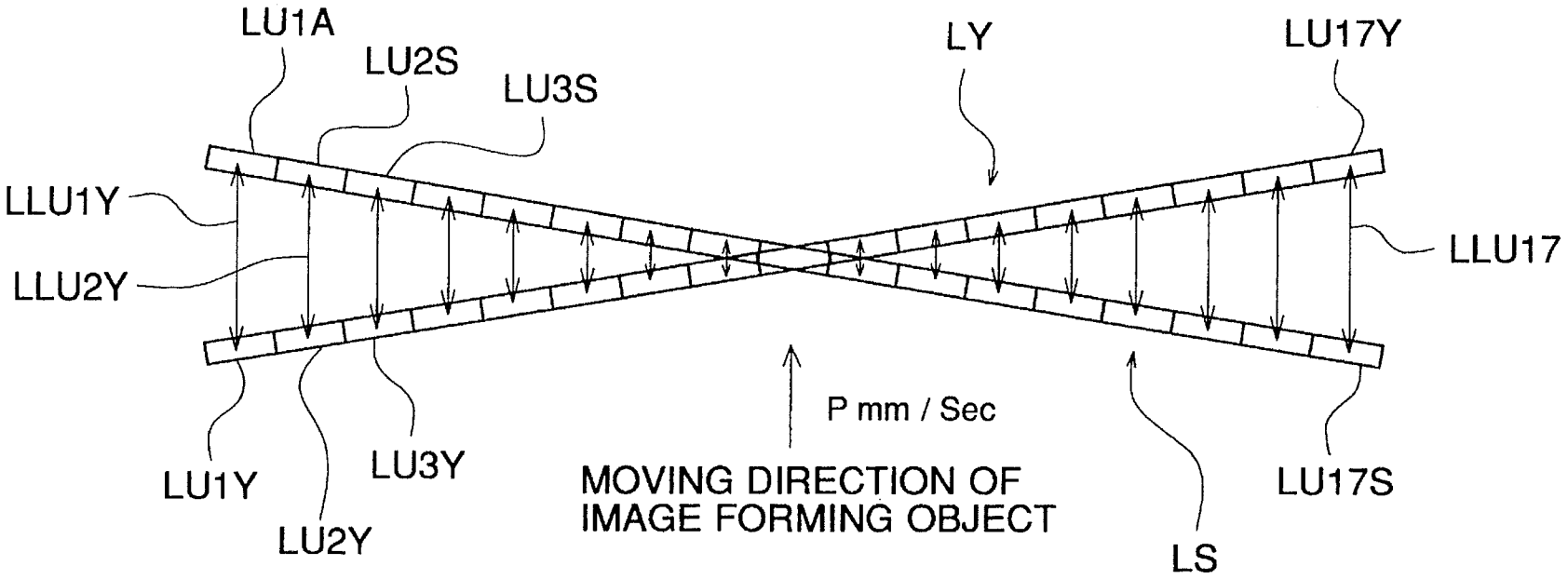
FIG. 15 is an illustration showing the relation of an amount of doubling of an LED array.

Each LED array(L) is arranged to be a straight line form in the direction perpendicular to the movement direction of photoreceptor drum 10 as shown in FIG. 15, and is divided into plural units (Divided into four in FIG. 14), for example, divided into 17 units (LU) and each unit(LU) of LED array (L) is named as LU1, LU2, . . . , LU17 in succession from the left. An amount of doubling of each unit of LED array(LY) for yellow(Y), for example, for the reference LED array(LS) is written in ROM(2)204 as doubling amount (LLU1Y, LLU2Y . . . ) of corresponding units (LU1Y for LU1S, LU2Y for LU2S, . . . ) generated when they are superposed on central LU9, for example, that is a reference point for exposure timing.

This doubling amount can easily be measured in the course of assembly and adjustment of the color image forming apparatus, and when this doubling amount is written in ROM(2) 204 in the course of assembly, installation adjustment in the course of assembly of LED array (L) is not needed, thus, time required for adjustment can be shortened greatly.

Following unit doubling amount (K is reference) of various exposure means written in ROM(2)204,

LLU1Y, LLU2Y, . . . LLU17Y

LLU1M, LLU2M, . . . LLU17M

LLU1C, LLU2C, . . . LLU17C are outputted to control section 201 when a color image is formed.

When forming images in the color image forming apparatus of the present example, imagewise exposure for yellow(Y) is first carried out on photoreceptor drum 10 which in the charged state.

An image data buffer section is shown with 205Y, and image data for one line are moved to the image data buffer section 205Y temporarily in the form which is divided for each unit.

An exposure time control circuit is shown with 206Y, and instruction of timing for the start of exposure for LED array (LY) is outputted to exposure time correction circuit for each unit 208 (LU1Y, LU2Y, . . . ) by an imagewise exposure program.

An exposure time correction control circuit for each unit is shown with 207Y, and corrected exposure time for each unit is calculated based on doubling amount for each unit of LED array (LY) called out by ROM(2)204 (LLU1Y, LLU2Y, . . . LLU17Y). When moving speed on the circumferential surface of photoreceptor drum 10 is P mm/sec, exposure control time for each unit (LU1Y, LU2Y, . . . LU1Y) is LLUnY/P sec (m:1–17), and exposure correction time calculated in terms of doubling amount to accelerate the exposure by an amount of LLUnY/P sec for the upstream side for the movement direction of photoreceptor drum 10 and to delay the exposure by an amount of LLUnY/P sec for the downstream side, is outputted to unit exposure time correction circuit 208 for each unit (LU1Y, LU2Y . . . LU17Y).

On the exposure time correction circuit for each unit 208 (LU1Y, LU2Y . . . LU17Y), an output is made in the form that the exposure start timing outputted from exposure time control circuit 206 is corrected by an amount of LLUnY/P sec, and each unit of LED array (LY) conducts imagewise exposure of image data with the aforementioned exposure start timing.

In the present example, imagewise exposure is carried out in the order of yellow(Y), magenta(M), cyan(C) and black(K). However, imagewise exposure control section(K) for black(K) does not need correction of imagewise exposure timing became LED array(LK) for black(K) is a reference for imagewise exposure timing correction.

A control method in image forming of the invention is extremely effective in color image forming wherein two or more different imagewise exposure means are used so that toner images are superimposed on an image forming object, but, no effect is observed in the case of monochromatic images. In a monochromatic mode, therefore, exposure timing control for each unit related to the invention can be canceled and is canceled automatically in the color image forming apparatus explained above.

An apparatus and control in the invention explained above have an excellent effect for eliminating doubling amount in the case of superimposing toner images.

For easy explanation, how the exposure timing of LED array (LC) of optical exposure system 12(C) for LED array (LY) of optical exposure system 12(Y) is controlled (will be explained as follow) when forming a green line-shaped image by superposing yellow(Y) toner and cyan(C) toner on the aforementioned apparatus.

Figure 16:
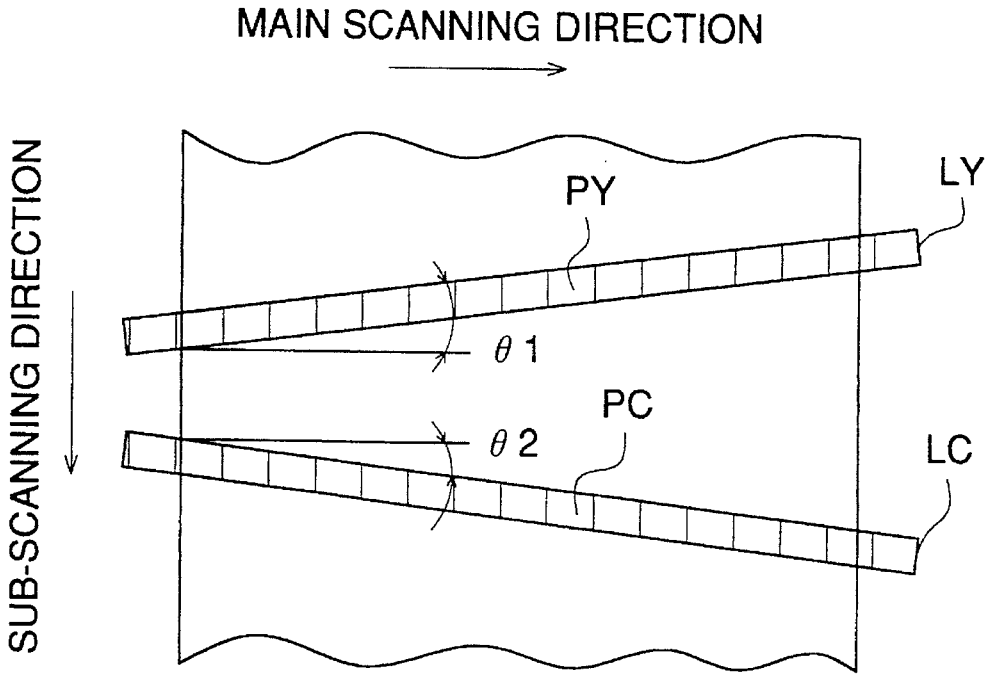
FIGS. 16(*a*) and 16(*b*) are illustrations showing the results of exposure timing control of the invention (Part 1).
Figure 16:
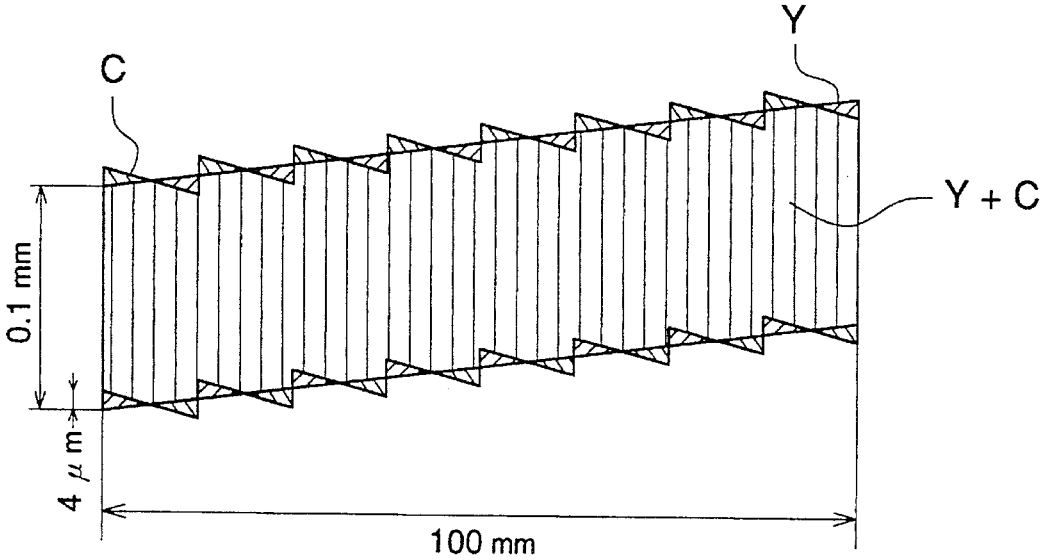

The LED array (LY) and the LED array (LC) both mentioned above are arranged to be a straight line in form and to be tilted respectively by angle 81 and 82 both opposite in direction each other from the direction perpendicular to the moving direction of photoreceptor drum 10, keeping the predetermined interval in the moving direction of photoreceptor drum 10, as shown in FIG. 16(*a*).

Each LED array is divided into plural exposure units (4 units or more in general, and 17 units in the present example) in its straight line direction. With regard to LED array(LY), a central exposure unit is a reference point PY in terms of exposure timing, and each exposure unit conducts exposure at the same timing. With regard to LED array (LC), on the other hand, a central exposure unit is reference point PC in terms of exposure timing for the aforesaid LED array(LY), and exposure control is made for agreement an imagewise exposure program established in advance.

Timing of imagewise exposure for each of other exposure units is advanced on delayed based on doubling amount inputted in advance against imagewise exposure of each exposure unit of corresponding LED array (LY), and thereby exposure timing is controlled so that the contours of a green (Y+C) toner image may show a fine a serration form as showing in FIG. 16(*b*).

For example, when each exposure unit is divided to be in length of 12.5 mm and angles of 81 and 82 of each LED array are respectively within 1 minute, a 0.1 m-thick and 100 mm-long line-shaped image to be formed on the circumferential surface of photoreceptor drum 10 can form a green image area wherein two colors (Y+C) mostly agree expect that minute monochromatic areas of yellow (Y) or cyan (C) only which are about 4 μm in size and can not be observed are mixed in the contours portion in a serration form mentioned above. Thus, it is possible to obtain color images with high image quality wherein no doubling is observed in practical use.

Figure 17:
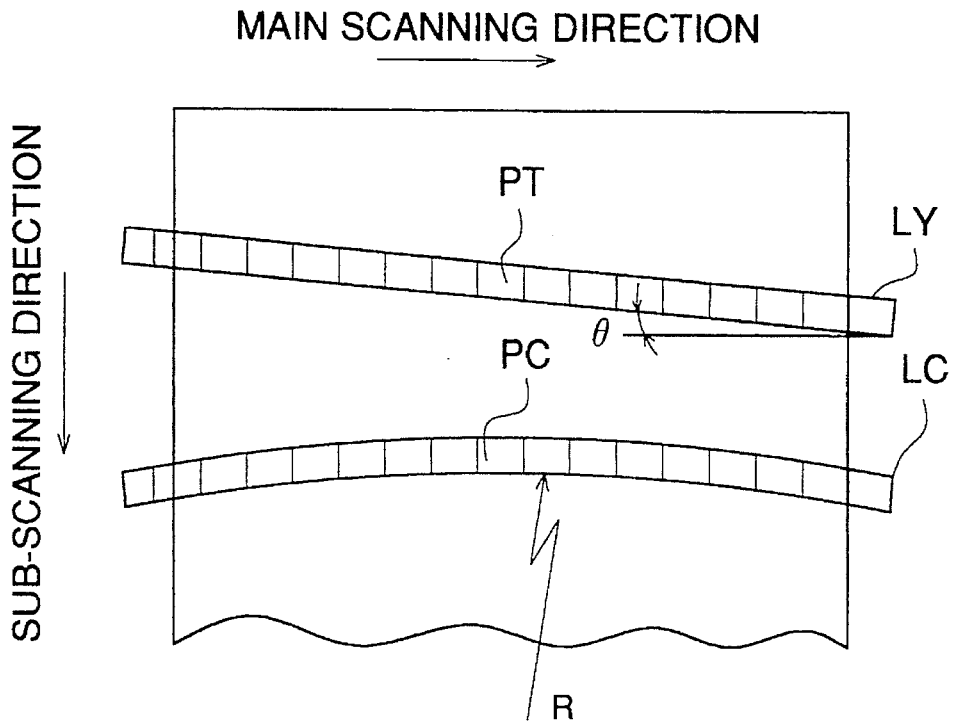
FIGS. 17(*a*) and 17(*b*) are illustrations showing the results of exposure timing control of the invention (Part 2).
Figure 17:
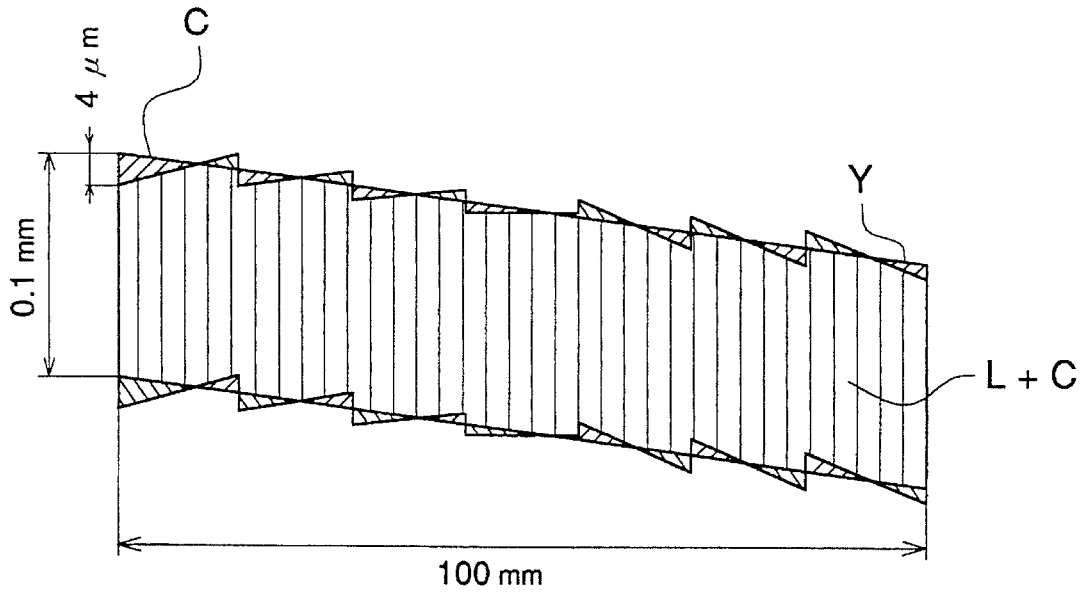

The control of exposure timing for individual exposure unit of LED array mentioned above can be utilized also for an adjustment of exposure timing of an LED array which is not in a straight line form as shown in FIG. 17(*a*).

LED array (LY) shown in FIG. 17(*a*) is in a form of a straight line inclined by an angle of 9 from the direction perpendicular to the moving direction of photoreceptor drum 10, and LED array (LC), on the other hand, is an LED array curved to be a form a circular are with radius of curvature R for the moving direction of the photoreceptor drum 10.

Under the condition that the aforesaid LED array (LY) and LED array (LC) are divided respectively into plural exposure units depending on the sizes of the angle θ and radius curvature R mentioned above, and central exposure units are made to be reference point PL and reference point PC respectively for timing control, as in the previous example, it is possible to limit a monochromatic area to an invisible size by advising or delaying exposure timing of each exposure unit on the part of LED array (LC) based on doubling amount inputted in advance for imagewise exposure of exposure unit on the part of corresponding LED array(LY).

Figure 18:
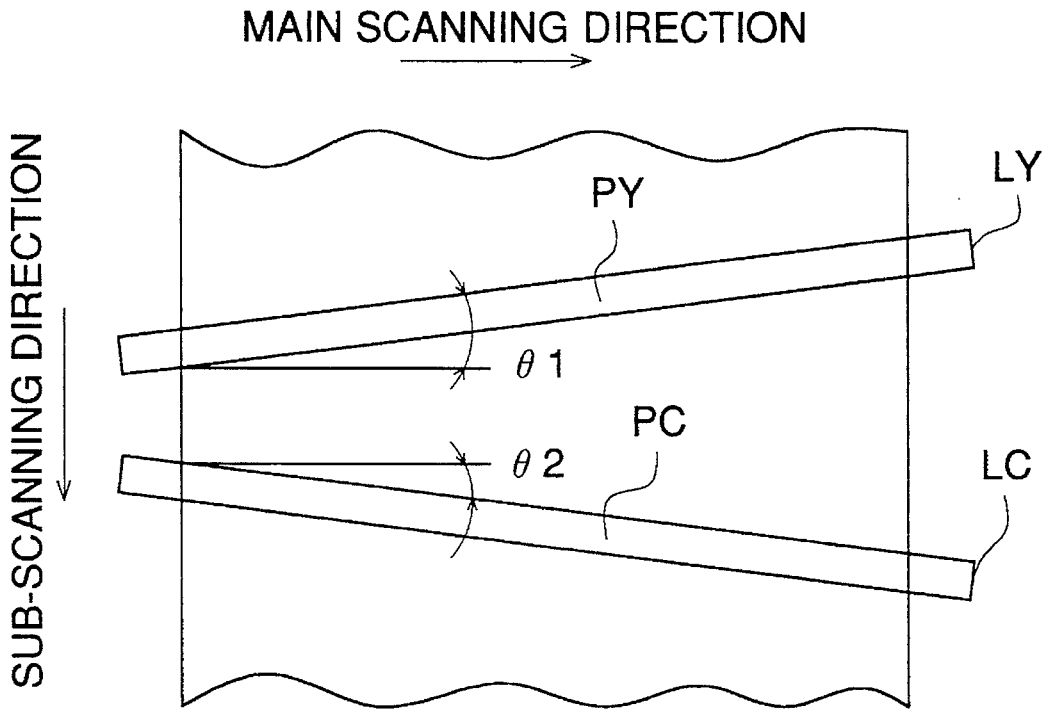
FIGS. 18(*a*) and 18(*b*) are illustrations showing the results of a conventional exposure timing control.
Figure 18:
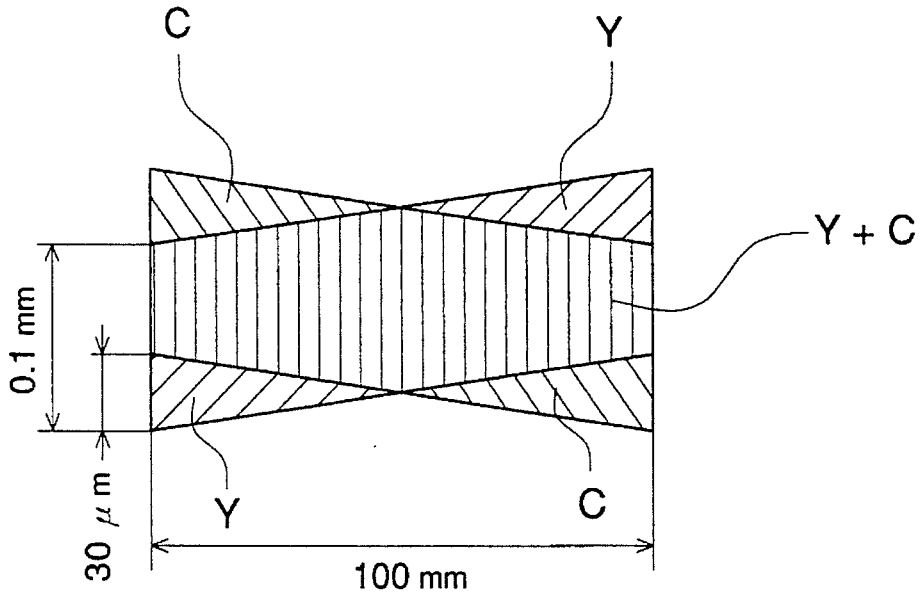
Figure 19:
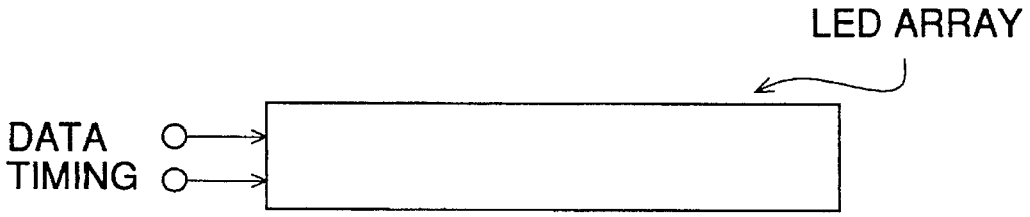
FIGS. 19(*a*), 19(*b*) and 19(*c*) are illustrations showing a conventional exposure timing control system.
Figure 19:
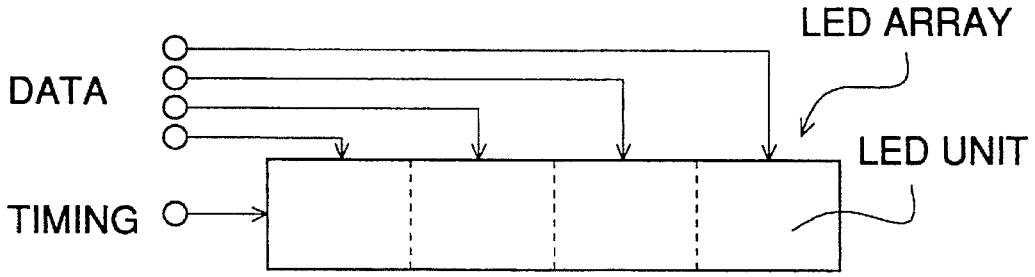
Figure 19:
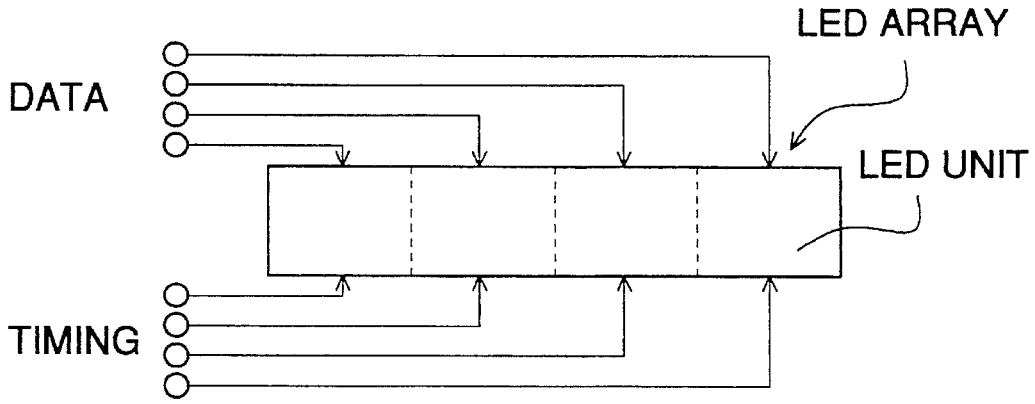
Figure 20:
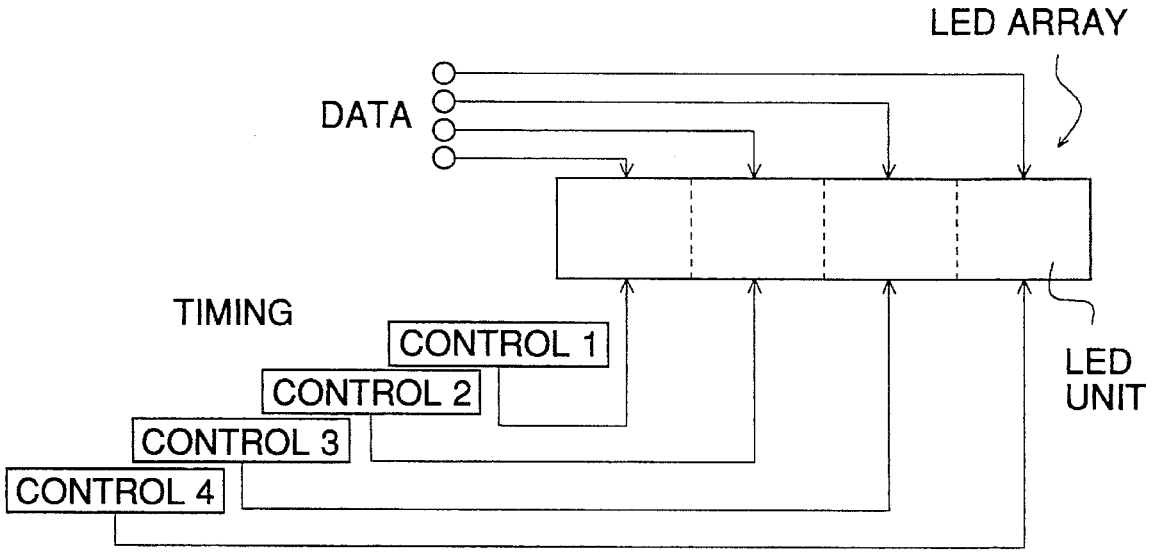
FIG. 20 is an illustration showing the exposure timing control system of the invention.
Figure 21:
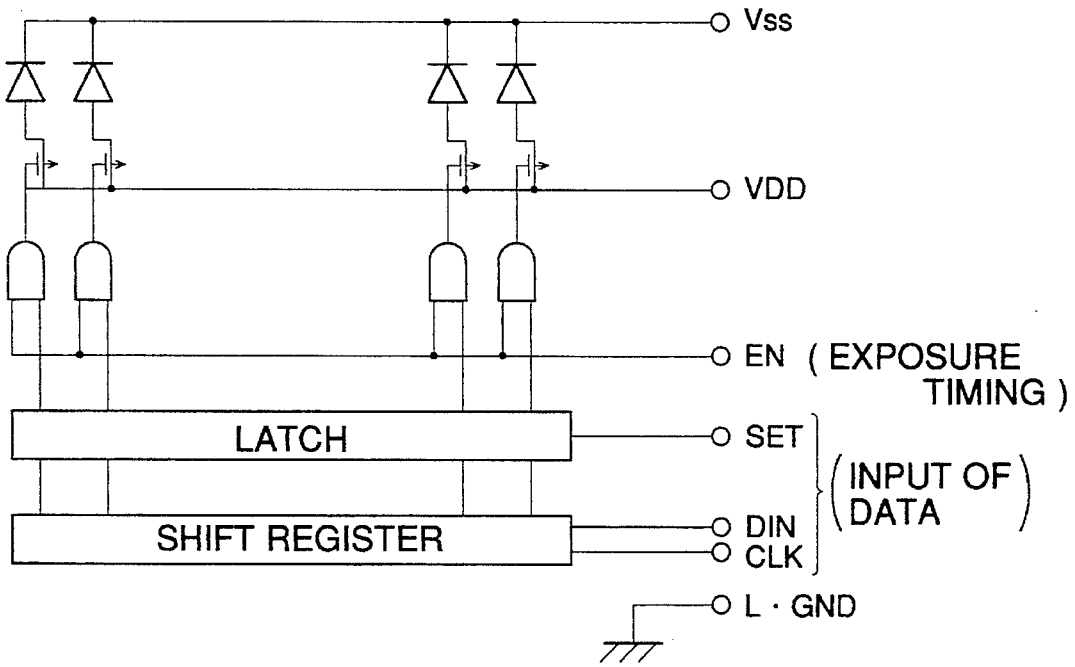
FIG. 21 is equivalent circuit of an LED array.

Incidentally, when exposure timing is controlled by respective central reference points PY and PC integrally without using the control method of the invention and without dividing the aforementioned LED array (LY) and LED array (LC) into plural exposure units as in a conventional way as shown in FIG. 18(*a*), caused by inclination of the LED array appears noticeably, and when the inclination angles 81 and 82 of the LED array are made to be 1 minute as in the previous example, a monochromatic area of yellow (Y) only and that of cyan (C) only generated on an image having thickness of 0.1 mm and length of 100 mm appear to be 30 μm and doubling is clearly observed, resulting in great deterioration of color images.

Owing to the invention, even when plural LED arrays constituting an imagewise exposure means are not uniform in terms of straightness and direction, doubling of an image formed can be corrected to the degree that is not problematic in practical use, resulting in an offer of a color image forming apparatus and a control method therefor wherein it is possible to obtain color images with high image quality free from doubling and color blotting.

The example explained above is represented by a color image forming apparatus wherein plural imagewise exposure means are provided inside a photoreceptor drum and imagewise exposure is made from the inside through a transparent base member. The invention, however, is not limited thereto, but it includes a color image forming apparatus wherein plural imagewise exposure means are provided outside a photoreceptor drum and imagewise exposure is made from the outside of the photoreceptor drum. In the invention, an image forming member is not limited to a photoreceptor drum but it may include also a belt photoreceptor. In this case, imagewise exposure made from the inside of the belt photoreceptor and imagewise exposure made from the outside thereof are all included in the invention. Further, even in the case of s color image forming apparatus wherein red, blue and green light sources are used as an imagewise exposure means and imagewise exposure is made on a silver salt photoreceptor, the invention is extremely effective for solving the problem of doubling.

(EXAMPLE 5)

Example 5 of the invention will be explained as follows, referring to FIGS. 22–25.

Figure 22:
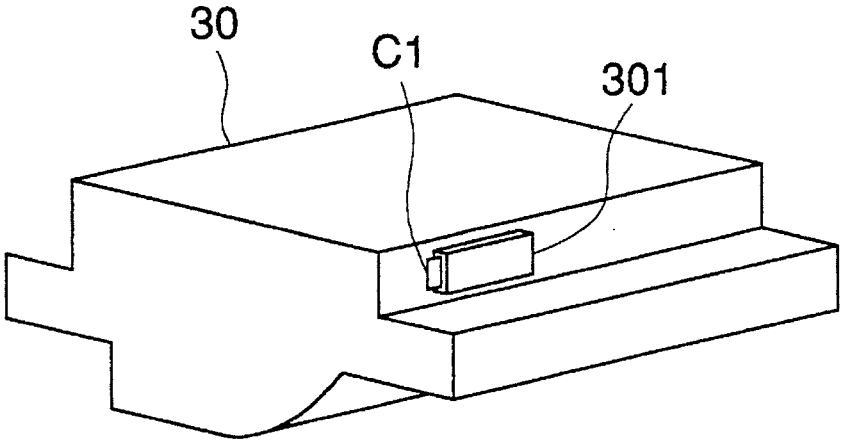
FIGS. 22(*a*) and 22(*b*) are illustrations showing a method of registration control to be done after replacement of image forming objects.
Figure 22:
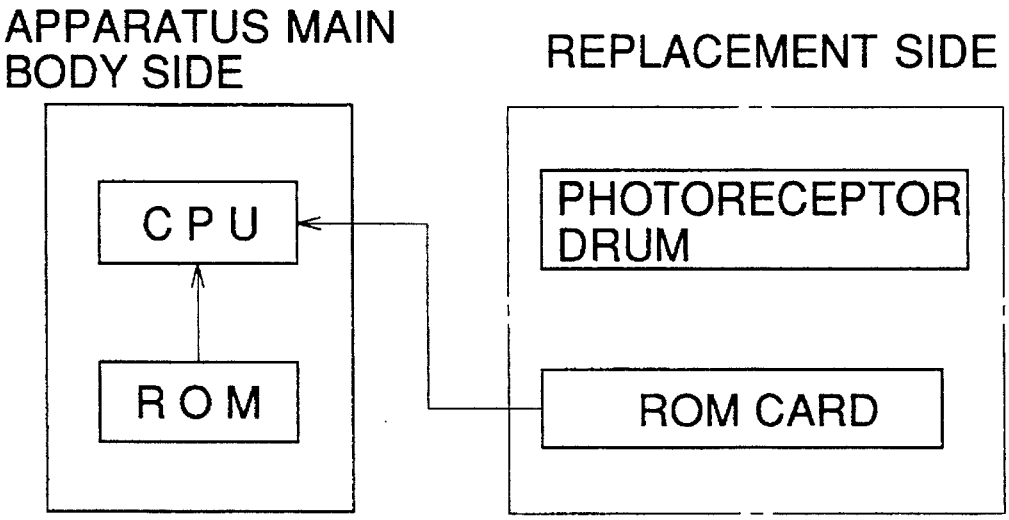

The aforementioned cartridge 30 is provided thereon with card insertion unit 301 into which a ROM card C1 wherein an outer diameter, sensitivity and potential characteristcs of a photoreceptor of photoreceptor drum 10 and further history of usage thereof are stored as registration control data is inserted to be integrated as shown in FIG. 22(*a*).

Figure 25:
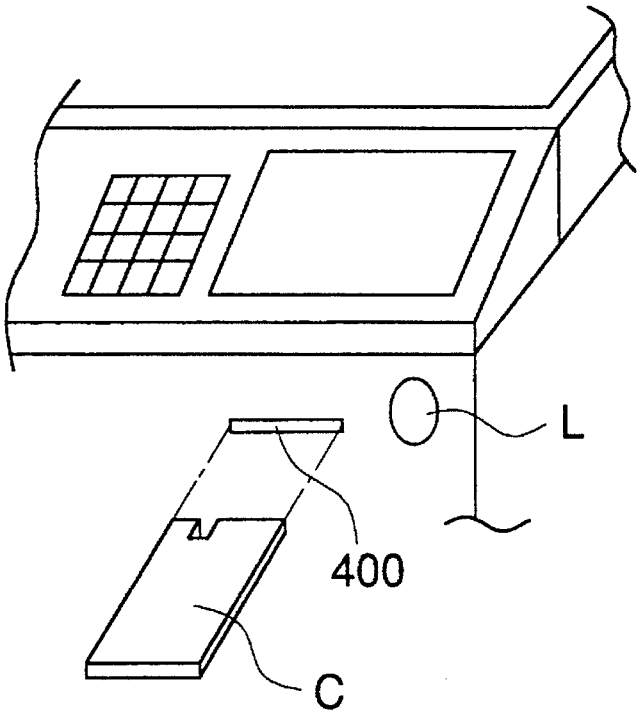
FIG. 25 is a perspective view showing an insertion section for a ROM card.

When the cartridge 30 is mounted on the apparatus main body, the ROM card C1 is pulled out of the card insertion unit 301 and is inserted into card insertion unit 400 as shown in FIG. 25. Then, the outer diameter dimensions, characteristics and history of usage of the photoreceptor drum 10 are inputted in CPU on the apparatus main body as registration control data as shown in a black diagram in FIG. 22(*b*).

On the other hand, in the control system on the apparatus main body, there is housed a ROM wherein imagewise exposure timing of the optics exposure system 12 corresponding to variation of the aforesaid characteristics values on the photoreceptor drum 10 of inputted ROM card C1 and correction values for exposure light quantity are stored, and based on information from the ROM card C1, exposure timing of each optics exposure system 12 and exposure light quantity are corrected so that the image forming process can be performed.

Incidentally, in the aforesaid example, it is also possible that outer diameter dimensions of a photoreceptor drum are classified into plural levels, an a classified level number of the photoreceptor drum 10 is recorded in ROM card C1, while, the classified level number and corresponding exposure timing table are contained in ROM on the apparatus main body, and thereby the image forming process is performed by the exposure timing on the exposure timing table corresponding to the classified level number in the ROM card C1 read by the apparatus main body.

In the apparatus, therefore, there is no color doubling in superposed toner iamges even in the case of different outer diameter dimensions of the replaced photoreceptor drum 10, and even when characteristics of sensitivity and potential of a photoreceptor are lowered slightly, it is still possible to form color images with well-balanced color by appropriate exposure light quantity.

Incidentally, in the apparatus provided with cartridge 30 and the ROM card C1 accompanying the cartridge 30, an image forming process is made to be on the state of stand-by, and when either one of the two mentioned above is not provided, warning lamp L is lit and the process operation is made to be on the state of prohibition.

Figure 23:
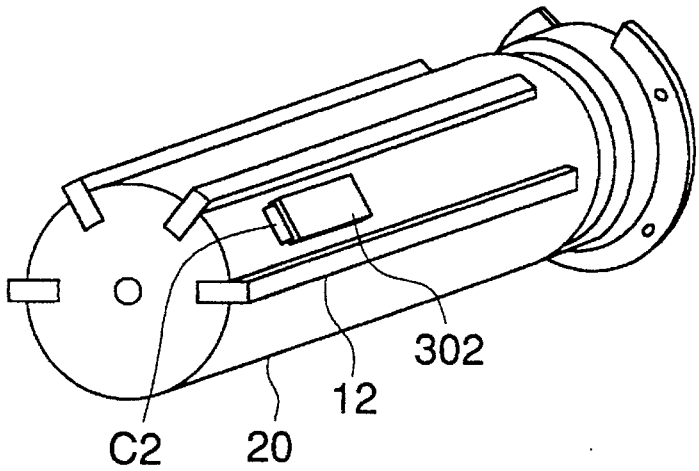
FIGS. 23(*a*) and 23(*b*) are illustrations showing a method of registration control to be done after replacement of imagewise exposure means.
Figure 23:
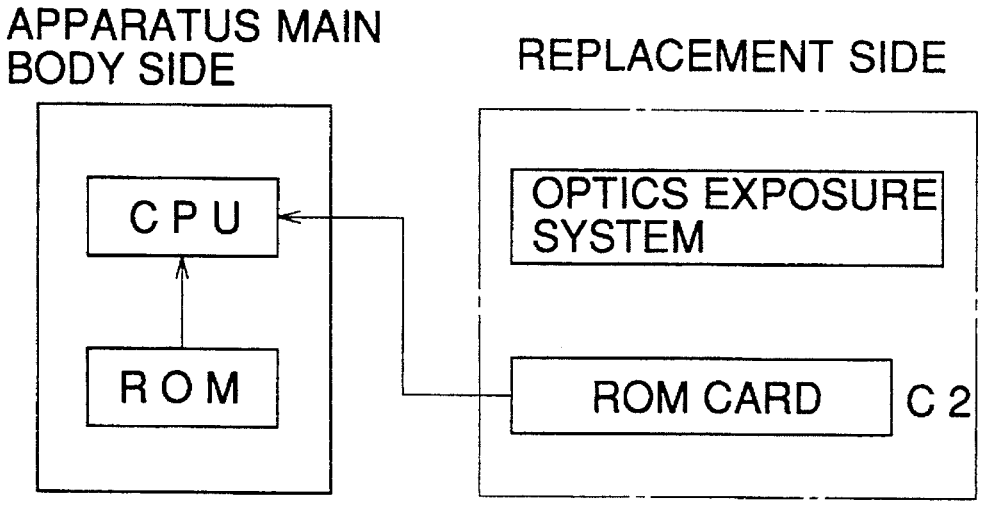

FIG. 23 shows an example of an apparatus wherein aforementioned optics exposure system 12 can be replaced as a cartridge, and the aforementioned supporting member 20 is provided thereon with card insertion unit 302 into which ROM card C2 wherein an interval of optics exposure system 12 and emission characteristics are stored as registration control data is inserted to be integrated as shown in FIG. 23(*a*).

When the ROM card C2 is inserted in card insertion section 400 of the apparatus main body, registration control data such as an interval of optics exposure system 12 and emission characteristics which are contained in the ROM card C2 are inputted in CPU on the apparatus main body as shown in FIG. 23(*b*).

On the other hand, in the control system on the apparatus main body, there is housed a ROM wherein imagewise exposure timing of the optics exposure system 12 corresponding to variation of the aforesaid characteristics values on the optics exposure system 12 of inputted ROM card C2 and correction values for emission light quantity are stored, and based on information from the ROM card C2, exposure timing and exposure light quantity of optics exposure system 12 are corrected so that the image forming process can be performed.

Figure 24:
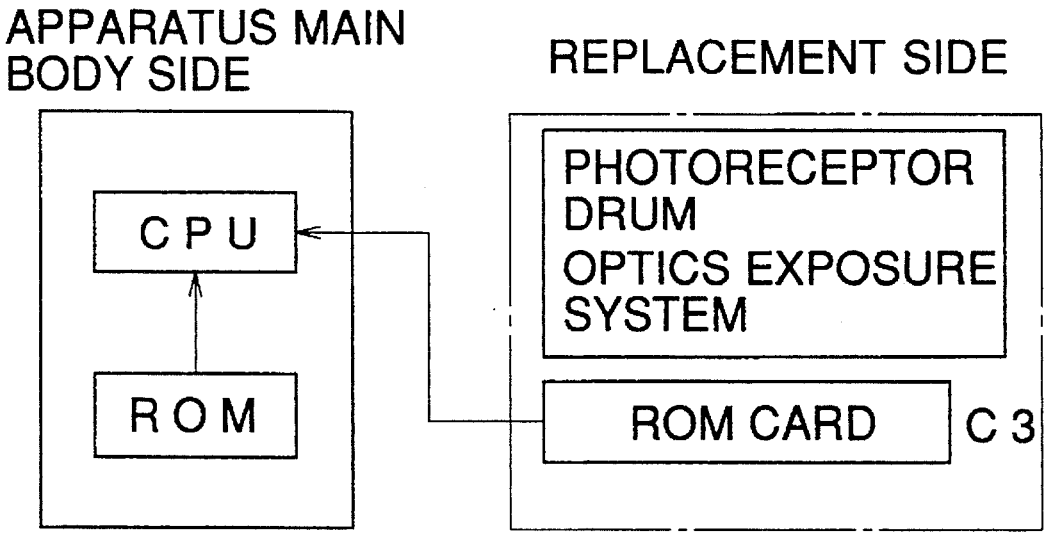
FIG. 24 is an illustration showing a method of registration control to be done after simultaneous replacement of the image forming objects and imagewise exposure means.

Further, when both photoreceptor drum 10 and optics exposure system 12 are replaced in a form of a pair as a cartridge, the aforesaid registration control data of a pair of photoreceptor drum 10 and optics exposure system 12 are stored in one ROM card C3, and by inserting the ROM card C3 in card insertion section 400 on the apparatus main body, it is possible to input such information in CPU simultaneously and thereby to adjust a pheripheral speed of photoreceptor drum 10 or imagewise exposure timing of optics exposure system 12 as shown in FIG. 24.

(EXAMPLE 6)

Example 6 of the invention will be explained as follows, referring to FIGS. 25 and 26.

Figure 26:
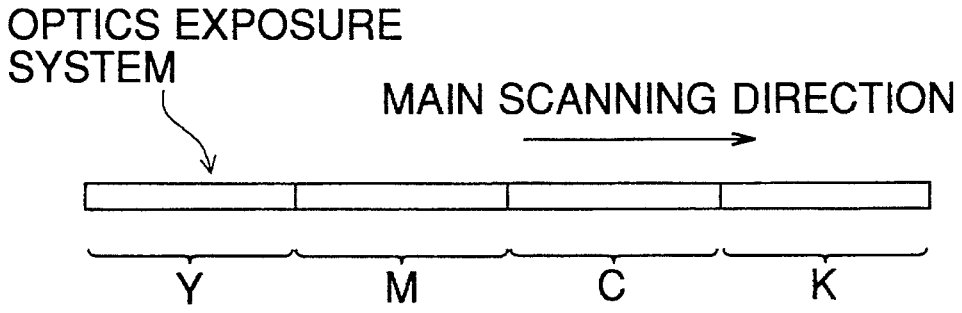
FIGS. 26(*a*), 26(*b*) and 26(*c*) are illustrations showing a method for adjusting the registration set value in Example 2.
Figure 26:
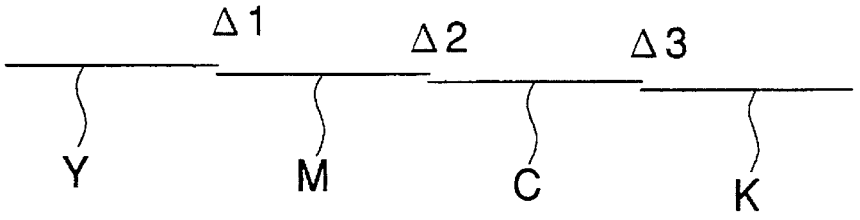
Figure 26:
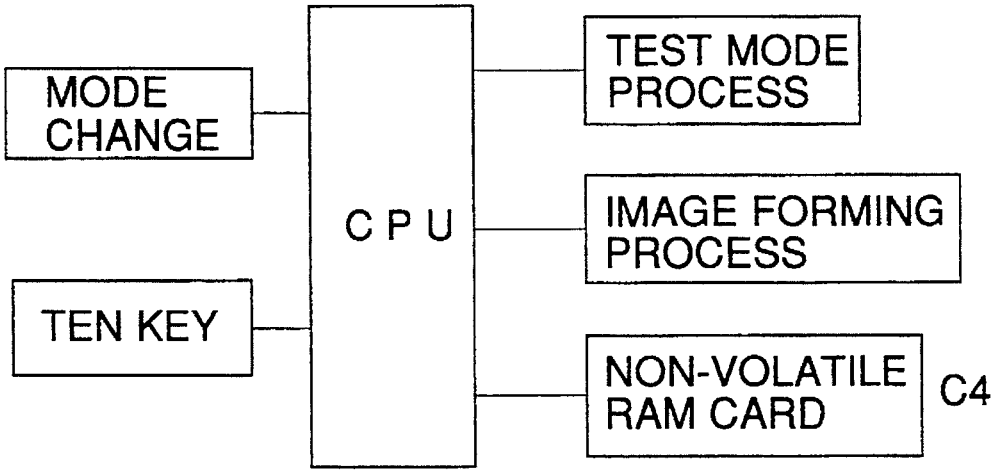

In the control system of the present apparatus, the aforementioned regular image forming process and a test mode for obtaining a test pattern print which will be started later are stored in CPU as shown in FIG. 26(*c*), and further, registration set values are inputted when RAM card C4 that is a non-volatile memory means is inserted.

When the test mode process mentioned above is selected by changing modes, the aforesaid optics exposure systems 12(Y), 12(M), 12(C) and 12(K) conduct imagewise exposure with a unit divided into four from the upstream side in the main scanning direction as shown in FIG. 8 (a), thus, through development, a test pattern print wherein yellow (Y) line, magenta (M) line, cyan (C) line and black (K) line are formed in series can be obtained.

When all lines mentioned above are aligned on a straight line, registration setting stored in RAM card C4 is appropriate and no correction is needed. However, when deviation Δ is observed on each line as shown in the figure, a serviceman analizes the test pattern print, and corrects, based on the results of the analysis, the registration set values stored in RAM card C4 through ten key operation in accordance with the amount of deviation Δ so that all lines are aligned on one straight line. By inserting the corrected RAM card C4, toner images are superposed without any deviation, and a color image with well-balanced color can be obtained.

The RAM card C4 mentioned above is arranged to be housed when it is inserted in card insertion section 400 of the apparatus main body as shown in FIG. 25. Therefore, it is possible to prepare RAM card C4 wherein registration values adjusted to the analysis of the test pattern print are set newly, and thereby to replace the previous RAM card C4 with that new one.

(EXAMPLE 7)

Example 7 of the invention will be explained as follows, referring to FIG. 27.

Figure 27:
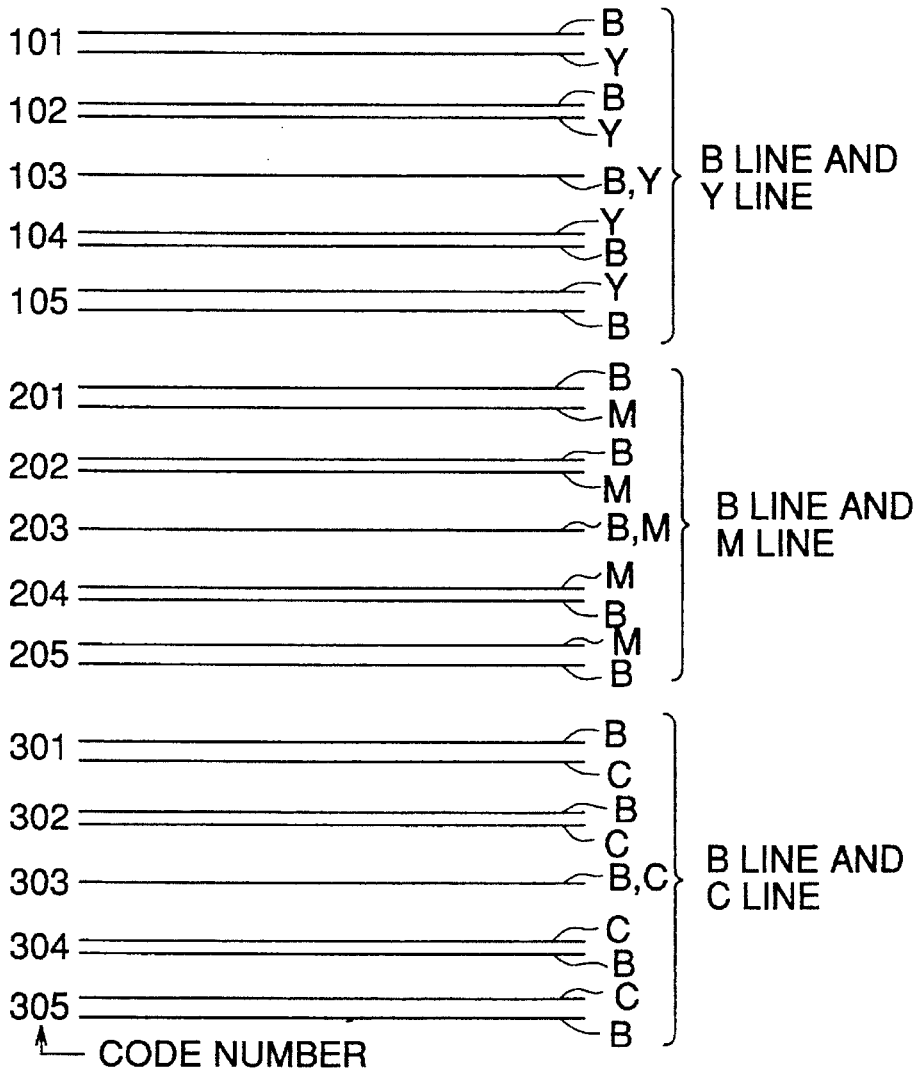
FIGS. 27(*a*) and 27(*b*) are illustrations showing a method for adjusting the registration set value in Example 3.
Figure 27:
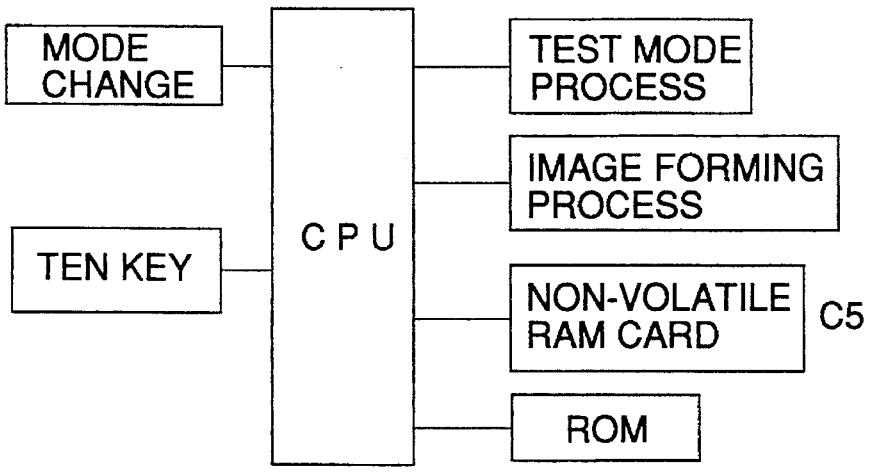

In the control system of the present apparatus, the aforementioned regular image forming process and a test mode process for obtaining a test pattern print which will be stated later are stored as shown in FIG. 27(*b*), and further, RAMC 5 is provided as a non-volatile memory means, thus, registration set values are stored and are newly inputted.

When the test mode process mentioned above is selected through mode change, the aforesaid optics exposure systems 12(Y), 12(M), 12(C) and 12(K) form, in accordance with the test mode program, three sets of test patterns each forming a line shape in the main scanning direction as shown in FIG. 27(*a*). Upper test patterns are a test pattern set for detecting color doubling based on imagewise exposure of black (K) and yellow (Y), intermediate test patterns are a test pattern set for detecting color doubling based on imagewise exposure of black (K) and magenta (M), and lower test patterns are a test pattern set for detecting color doubling based on imagewise exposure of black (K) and cyan (C). Each test pattern set is composed of plural test patterns wherein a pair of other optics exposure systems with an exposure timing for black (K) as a reference that varied in terms of exposure timing to (+) or (−) direction, and each test pattern is capable of being given a code number or marking.

A user checks a test pattern print obtained through a test print mode, then, setects from test pattern sets the specific pattern wherein two lines are aligned, and inputs the code number for that specific pattern by means of a ten key provided on an operation panel of the apparatus main body, for example. In the apparatus main body, there is stored a table containing the code number and exposure timing of each optics exposure system corresponding to the code number, and CPU reads exposure timing of each optics exposure system corresponding to the inputted code number from the table to store the registration information in RAMC 5. When a user releases the test mode for copying, image forming is conducted by exposure timing of optics exposure system stored in newly in RAMC 5. Therefore, registration adjustment is completely made and an excellent color image that is free from color doubling can be obtained.

With regard to a copying machine, it is possible to carry out registration adjustment in the manner stated below. Namely, in the test print mode wherein marking is given to a test pattern, a user checks test pattern print obtained, selects the specific pattern wherein two lines are aligned from test pattern sets, gives the corresponding marking, places the test print pattern having therein a marking, and makes the marking to be read by reading operation, while CPU reads from the table the exposure timing for each optics exposure system corresponding to the read marking information so that the registration information may be stored in RAMC 5. Even in the case of the present example, when a user releases the test mode for copying, image forming can be carried out by exposure timing of the optics exposure system stored newly in RAMC 5.

Owing to the invention, an amount of registration change caused by replacement of an image forming object or an imagewise exposure means can be corrected by ROM card replaced simultaneously, and can be corrected by being grasped properly by the test pattern print obtained through a test mode, and thereby a color image forming apparatus capable of forming a highly graceful image wherein accuracy of superposing toner images is high.

What is claimed is:

1. A color image forming apparatus, comprising:

an image carrier;

charging means for electrically charging the image carrier;

a plurality of image exposing devices for exposing the image carrier so as to form latent images on the image carrier;

a plurality of developing devices for developing the latent images with color toners so as to form a plurality of color toner images, each of the plurality of developing devices developing one of the latent images with a different color toner;

a controller for controlling the image carrier, the charging means, the image exposing devices, and the developing devices so that the plurality of color toner images are formed one after another and superimposed on the image carrier; said controller comprising a regulator for adjusting a positional relation among the plurality of color toner images; and a transfer device for transferring the plurality of color toner images superimposed on the image carrier onto a transfer sheet;

wherein each of the plural image exposing devices has an exposing position on the image carrier and the plural image exposing devices are arranged in such a manner that the plural exposing positions of the plural image exposing devices are spaced with each other substantially with an equal distance therebetween, and wherein the regulator regulates a circumferential speed of the image carrier so as to compensate positional deviation among the plural exposing devices.

2. The apparatus of claim 1, wherein the plural exposing positions of the plural exposing devices are not changed.

3. The apparatus of claim 1, wherein the regulator regulates the circumferential speed of the image carrier in accordance with a change in temperature of the image carrier.

4. A color image forming apparatus, comprising:

an image carrier;

charging means for electrically charging the image carrier;

a plurality of image exposing devices for exposing the image carrier so as to form latent images on the image carrier;

a plurality of developing devices for developing the latent images with color toners so as to form a plurality of color toner images, each of the plurality of developing devices developing one of the latent images with a different color toner;

a controller for controlling the image carrier, the charging means, the image exposing devices, and the developing devices so that the plurality of color toner images are formed one after another and superimposed on the image carrier; said controller comprising a regulator for adjusting a positional relation among the plurality of color toner images; and a transfer device for transferring the plurality of color toner images superimposed on the image carrier onto a transfer sheet;

wherein the plural exposing devices are supported by a supporting member, and the regulator regulates an exposing timing of each of the plurality of image exposing devices in accordance with a change in temperature of the supporting member.

5. A color image forming apparatus, comprising:

an image carrier;

charging means for electrically charging the image carrier;

a plurality of image exposing devices for exposing the image carrier so as to form latent images on the image carrier;

a plurality of developing devices for developing the latent images with color toners so as to form a plurality of color toner images, each of the plurality of developing devices developing one of the latent images with a different color toner;

a controller for controlling the image carrier, the charging means, the image exposing devices, and the developing devices so that the plurality of color toner images are formed one after another and superimposed on the image carrier; said controller comprising the regulator for adjusting a positional relation among the plurality of color toner images; and a transfer device for transferring the plurality of color toner images superimposed on the image carrier onto a transfer sheet;

wherein each of the plural image exposing devices has an exposing position on the image carrier and the plural image exposing devices are arranged in such a manner that the plural exposing positions of the plural image exposing devices are spaced, and wherein the regulator regulates an exposing timing of each of the plural image exposing devices in accordance with a distance between the exposing positions, and wherein the regulator has an initial set value of the exposing timing corresponding to a reference distance and changes the initial set value in proportional to a ratio of the distance to the reference distance.

6. A color image forming apparatus, comprising:

an image carrier;

charging means for electrically charging the image carrier;

a plurality of image exposing devices for exposing the image carrier so as to form latent images on the image carrier;

a plurality of developing devices for developing the latent images with color toners so as to form a plurality of color toner images, each of the plurality of developing devices developing one of the latent images with a different color toner;

a controller for controlling the image carrier, the charging means, the image exposing devices, and the developing devices so that the plurality of color toner images are formed one after another and superimposed on the image carrier; said controller comprising a regulator for adjusting a positional relation among the plurality of color toner images; and a transfer device for transferring the plurality of color toner images superimposed on the image carrier onto a transfer sheet;

wherein the regulator regulates an angular speed of the image carrier and an exposing timing of the image exposing device on a basis of a common reference clock.

7. A color image forming apparatus, comprising:

an image carrier;

charging means for electrically charging the image carrier;

a plurality of image exposing devices for exposing the image carrier so as to form latent images on the image carrier;

a plurality of developing devices for developing the latent images with color toners so as to form a plurality of color toner images, each of the plurality of developing devices developing one of the latent images with a different color toner;

a controller for controlling the image carrier, the charging means, the image exposing devices, and the developing devices so that the plurality of color toner images are formed one after another and superimposed on the image carrier, said controller comprising a regulator for adjusting a positional relation among the plurality of color toner images; and a transfer device for transferring the plurality of color toner images superimposed on the image carrier onto a transfer sheet;

wherein the image carrier moves in a predetermined moving direction and each of the plural image exposing devices is shaped in a lone and arranged in perpendicular to the moving direction of the image carrier, and wherein the line-shaped image exposing device is split into plural units along the line and is controlled to conduct an exposure for each unit, and wherein the positional deviation of each unit is measured when the apparatus was built.

8. The apparatus of claim 7, wherein one of the plural image exposing devices is used as a reference image exposing device and the regulator comprises a memory to store an amount of a positional deviation of each unit of another one of the plural image exposing devices when the exposing position of the another one of the plural image exposing devices is superimposed on that of the reference image exposing device, and wherein the regulator regulates an exposing timing of each unit on a basis of the positional deviation stored in the memory.

9. The apparatus of claim 7, wherein the line-shaped image exposing device is a LED array.

10. The apparatus of claim 7, wherein when a multi-color image forming mode is selected, the regulator regulates automatically an exposing timing of each unit.

11. The apparatus of claim 7, wherein the reference image exposing device is an image exposing device for black.

12. The apparatus of claim 7, wherein the positional deviation of a unit extends upstream of the reference position in relation to the moving direction of the image carrier, and the exposing timing of the unit is made earlier than that when the unit locates on the reference position.

13. The apparatus of claim 7, wherein the positional deviation of a unit extends downstream of the reference positional relation to the moving direction of the image carrier, and the exposing timing of the unit is delayed from that when the unit locates on the reference position.

14. A color image forming apparatus, comprising: an image carrier;

charging means for electrically charging the image carrier;

a plurality of image exposing devices for exposing the image carrier so as to form latent images on the image carrier;

a plurality of developing devices for developing the latent images with color toners so as to form a plurality of color toner images, each of the plurality of developing devices developing one of the latent images with a different color toner;

a controller for controlling the image carrier, the charging means, the image exposing devices, and the developing devices so that the plurality of color toner images are formed one after another and superimposed on the image carrier; said controller comprising a regulator for adjusting a positional relation among the plurality of color toner images; and a transfer device for transferring the plurality of color toner images superimposed on the image carrier onto a transfer sheet;

wherein at least one of the image carrier and the plural image exposing devices is adapted to bear a registration data with regard to the superimposition of the plural color toner images and is replaced with a spare one together with the registration data.

15. The apparatus of claim 14, wherein the registration data is stored in a ROM card and is replaced by the replacement of the ROM card.

16. The apparatus of claim 14, wherein the registration data with regard to the image carrier is dimensions of the outer figure of the image carrier.

17. The apparatus of claim 14, wherein the registration data with regard to the image exposure devices is the distance between the image exposure devices.

18. The apparatus of claim 14, wherein the regulator has a test pattern for registration adjustment and has a memory to store a registration set value, and wherein the regulator changes the registration set value in accordance with an registration adjustment data obtained from the test pattern.

19. The apparatus of claim 14, wherein the regulator has a plurality of test patterns for registration adjustment for a plurality of exposing timing, selects one of the test patterns and resets the exposing timing in accordance with an registration adjustment data obtained from the selected test pattern.

20. The apparatus of claim 19, wherein a code No. corresponding is input so as to select one of the plurality of test patterns.

21. The apparatus of claim 19, wherein a mark is read so as to select one of the plurality of test patterns.

22. A color image forming apparatus, comprising:

an image carrier;

charging means for electrically charging the image carrier;

a plurality of image exposing devices for exposing the image carrier so as to form latent images on the image carrier;

a plurality of developing devices for developing the latent images with color toners so as to form a plurality of color toner images, each of the plurality of developing devices developing each of the latent images in different color toner;

a controller for controlling the image carrier, the charging means, the image exposing devices, and the developing devices so that the plurality of color toner images are formed one after another and superimposed on the image carrier;

said controller comprising a regulator for regulating an exposing timing of each of the plurality of image exposing devices, wherein one of the plurality of image exposing devices is used as a reference image exposing device and the exposing timing of another device of the plurality of image exposing devices is determined on the basis of the exposing timing of the reference image exposing device so as to eliminate the positional deviation to the reference image exposing device; and a transfer device for transferring the plurality of color toner images superimposed on the image carrier onto a transfer sheet.

23. The apparatus of claim 22, wherein the regulator regulates the exposing timing when the image carrier is replaced with a spare one.

24. The apparatus of claim 22, wherein the image carrier moves in a predetermined moving direction and each of the plural image exposing devices is shaped in a line and arranged in perpendicular to the moving direction of the image carrier, and wherein the line-shaped image exposing device is split into plural units along the line and the exposing timing is controlled for each unit.

25. The apparatus of claim 24, wherein said controller comprises a memory in which the exposing timing of each unit is stored.

26. The apparatus of claim 24, wherein the line-shaped image exposing device has a reference unit among the plural units and the exposing timing of other units are determined on the basis of the exposing timing of the reference unit.

27. The apparatus of claim 22, wherein the plurality of color toner images are yellow, magenta, cyan, and black, and the reference image exposing device is used to form the black toner image.

28. The apparatus of claim 22, wherein the reference image exposing device is the first one of the plurality of image exposing devices.

29. The apparatus of claim 22, further comprising a detector for detecting a temperature in the apparatus, wherein the exposing timing of each of the plurality of image exposing devices is adjusted by the regulator in accordance with the detected temperature.

* * * * *